US008926057B2

(12) United States Patent
Ueno

(10) Patent No.: US 8,926,057 B2
(45) Date of Patent: Jan. 6, 2015

(54) LIQUID EJECTION APPARATUS

(71) Applicant: Brother Kogyo Kabushiki Kaisha, Nagoya-shi, Aichi-ken (JP)

(72) Inventor: Takashi Ueno, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 111 days.

(21) Appl. No.: 13/629,489

(22) Filed: Sep. 27, 2012

(65) Prior Publication Data

US 2013/0106947 A1 May 2, 2013

(30) Foreign Application Priority Data

Oct. 27, 2011 (JP) ..... 2011-235688

(51) Int. Cl.
*B41J 2/165* (2006.01)

(52) U.S. Cl.
CPC ..... *B41J 2/16508* (2013.01); *B41J 2/16538* (2013.01); *B41J 2/16552* (2013.01); *B41J 2/16585* (2013.01); *B41J 2002/16573* (2013.01)
USPC ..... 347/21

(58) Field of Classification Search
None
See application file for complete search history.

(56) References Cited

U.S. PATENT DOCUMENTS

| | | | | |
|---|---|---|---|---|
| 6,183,058 | B1 * | 2/2001 | Sharma et al. | 347/28 |
| 6,595,617 | B2 * | 7/2003 | Sharma et al. | 347/28 |
| 2009/0015630 | A1 * | 1/2009 | Murayama | 347/33 |
| 2011/0242204 | A1 * | 10/2011 | Shinoda | 347/29 |
| 2012/0206537 | A1 | 8/2012 | Nukui et al. | |

FOREIGN PATENT DOCUMENTS

| | | | |
|---|---|---|---|
| JP | H09-085959 | A | 3/1997 |
| JP | 2000-079696 | A | 3/2000 |
| JP | 2003-165230 | A | 6/2003 |
| JP | 2003-334962 | A | 11/2003 |
| JP | 2012-166368 | A | 9/2012 |

* cited by examiner

*Primary Examiner* — Alejandro Valencia
(74) *Attorney, Agent, or Firm* — Baker Botts L.L.P.

(57) ABSTRACT

A liquid ejection apparatus includes a liquid ejection head, a capping unit, a supply unit, a wiping unit, and a control unit controlling these components. Upon receiving a maintenance signal, the control unit controls the capping unit and the supply unit so as to perform a second supplying operation of supplying air to an ejection space in an open state via a second opening, after a first supplying operation of supplying air to the ejection space in a sealed state via a first opening. Thereafter, the control unit controls the wiping unit and the capping unit so as to perform a wiping operation of wiping the surface of the opposing member and then switch the ejection space to the sealed state.

12 Claims, 14 Drawing Sheets

LIQUID EJECTION APPARATUS

CROSS-REFERENCE TO RELATED APPLICATION

The present application claims priority from Japanese Patent Application No. 2011-235688, which was filed on Oct. 27, 2011, the disclosure of which is herein incorporated by reference in its entirety.

BACKGROUND OF THE INVENTION

1. Field of the Invention

The present invention relates to a liquid ejection apparatus arranged to eject liquid through ejection openings.

2. Description of Related Art

A known inkjet recording apparatus caps the nozzle surface of a record head by means of a cap member and a conveyance belt, by causing the cap member formed around the record head to closely contact the conveyance belt. In such an inkjet recording apparatus, the cap member may include an annular side plate surrounding the record head and a flexible sheet having an outer circumferential edge fixed to the upper end of the side plate and an inner circumferential edge fixed to the outer side face of the record head.

SUMMARY OF THE INVENTION

In this inkjet recording apparatus, a narrow space is formed, on account of the deformation of the sheet, between the sheet and the outer side face of the record head or between the sheet and the side plate, when the side plate and the record head present a particular positional relationship. In the printing operation or purging operation, ink ejected from the record head may be trapped in this narrow space. Furthermore, when the apparatus in the capped state is tilted while it is moved, ink leaks out from the ejection opening and adheres to the side plate of the cap member, the inner surface of the sheet, the outer side face of the record head, or the like. Such adhering ink (residual ink) is dried and increases its viscosity over time. When the capping is executed while thickened ink adheres to the cap member and the outer side face of the record head, the thickened ink absorbs moisture from the ink around the ejection openings. As a result, the ink around the ejection openings is dried and the ejection Openings are clogged.

In consideration of the above, an object of the present invention is to provide a liquid ejection apparatus in which a liquid is less likely to remain in an ejection space.

A liquid ejection apparatus of the present embodiment includes: a liquid ejection head having an ejection surface on which a plurality of ejection openings are formed; a capping unit that includes an annular lip component enclosing the liquid ejection head, an opposing member opposing the ejection surface over an ejection space opposing the ejection surface, a lip moving mechanism moving the lip component between an abutting position where the lip component abuts to a surface of the opposing member and a separated position where the lip component is separated from the surface of the opposing member, and an elastic diaphragm connecting the lip component with a side face of the liquid ejection head, the capping unit being able to take either a sealed state in which the lip component is at the abutting position and abuts to the opposing member and the ejection space is isolated from an external space or an open state in which the lip component is separated from the opposing member and the ejection space is open to the external space; a supply unit that includes a first opening and a second opening provided to sandwich the ejection openings and supplies air to the ejection space via the first opening or the second opening; a wiping unit that executes a wiping operation to wipe the surface of the opposing member; a maintenance controller that controls the capping unit, the wiping unit, and the supply unit; and an output unit that outputs a maintenance signal either when a user performs a predetermined operation or when a predetermined condition concerning time is satisfied. When the lip component is positioned at the abutting position, a first path that allows air passing through the first opening to flow therein and extends along an inner circumferential surface of a first region of the lip component and a second path which allows air passing through the second opening to flow therein and extends along an inner circumferential surface of a second region of the lip component which region opposes the first region are formed, whereas, in the sealed state, a third path connecting the first path with the second path is formed between the lip component and a side face of the liquid ejection head, and when the maintenance signal is output from the output unit, the maintenance controller executes a first supplying operation to supply the air through the first opening to the ejection space in the sealed state, then executes a second supplying operation to supply the air through the second opening to the ejection space in the sealed state or the open state, and then establishes the sealed state after executing the wiping operation in the open state.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
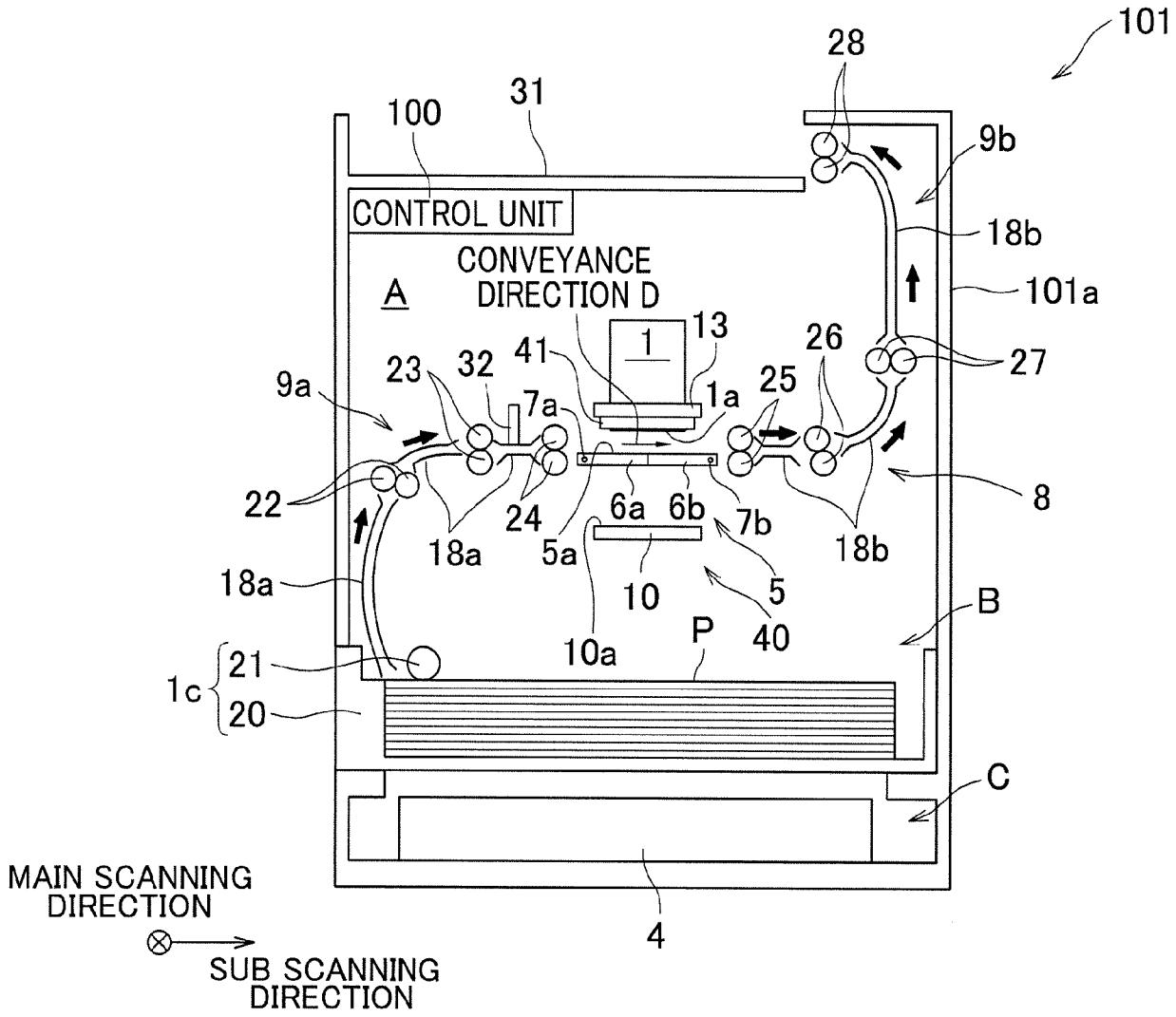
FIG. 1 is a schematic profile showing the internal structure of an inkjet printer as an embodiment of a liquid ejection apparatus of the present invention.

As shown in FIG. 1, an inkjet printer 101 has a rectangular parallelepiped chassis 101*a*. Above the top plate of the chassis 101*a* is provided a sheet discharge section 31. The internal space of the chassis 101*a* is divided into spaces A, B, and C from top to bottom. In the spaces A and B is formed a sheet conveyance path connecting a sheet feeding section 1*c* with the sheet discharge section 31, and a sheet P is conveyed along the black thick arrows shown in FIG. 1. In the space A, image formation on a sheet P and conveyance of the sheet P to the sheet discharge section 31 are carried out. In the space B, the sheet P is supplied to the conveying path. From the space C, ink is supplied to an inkjet head (liquid ejection head) 1 in the space A.

In the space A are provided components such as an inkjet head 1 (hereinafter, head 1) ejecting black ink, a conveyance mechanism 8, a capping mechanism (capping unit) 40, a sheet sensor 32, a moist air supply mechanism 50 for moisturizing operation (see FIG. 6A and FIG. 6B), a head elevating mechanism 30 (see FIG. 11), a wiper unit (wiping unit) 36 (see FIG. 13A to FIG. 13C), and a control unit 100.

The head 1 is substantially rectangular parallelepiped and is elongated along the main scanning direction and forms an image based on a drive signal. The head 1 is supported by the chassis 101*a* via the head holder 13. The head 1 is supported by the head holder 13 and oppose platens 6*a* and 6*b* with a predetermined gap being formed therebetween. The head 1 is a laminated body in which components such as a reservoir unit 12 (see FIG. 7A and FIG. 7B), a flexible printed circuit board (FPC), and a control substrate are laminated in addition to a head main body 3 (see FIG. 2). The reservoir unit 12 as an upstream passage member is provided with an upstream ink passage including a reservoir (both of which are not illustrated), and receives ink from a cartridge 4. The reservoir temporarily stores ink.

The passage unit 11 as a downstream passage member constitutes the head main body 3 with actuator units 21, and receives ink from the reservoir unit 12. The lower surface of the passage unit 11 is an ejection surface 1*a* where a plurality of ejection openings 108 are formed. Through the ejection openings 108, ink is ejected as the actuator units 21 are driven. The head 1 will be detailed later.

The control substrate adjusts a signal input from the control unit 100. An output signal is converted to a drive signal by a driver IC on the FPC and output to the actuator units 21 of the head main body 3. Each actuator unit 21 applies a pressure to the ink in the passage unit 11 upon receiving the drive signal.

The head holder 13 is provided with a cap 41 constituting the capping mechanism 40, in addition to the head 1. The cap 41 is an annular component provided for the head 1 and encloses the head therein in plan view. The arrangement, operation, function or the like of the capping mechanism 40 will be detailed later.

The conveyance mechanism 8 includes two guide units 9*a* and 9*b* guiding the sheet P and a supporting mechanism 5, and constitutes a sheet conveyance path. The two guide units 9*a* and 9*b* are disposed to sandwich the supporting mechanism 5 (two platens 6*a* and 6*b*). The guide unit 9*a* on the upstream in the conveyance direction includes three guides 18*a* and three feed roller pairs 22 to 24 and connects the sheet feeding section 1*c* with the platens 6*a* and 6*b*. A sheet P for image formation is conveyed toward the platens 6*a* and 6*b*. The guide unit 9*b* on the downstream in the conveyance direction includes three guides 18*b* and four feed roller pairs 25 to 28, and connects the platens 6*a* and 6*b* with the sheet discharge section 31. The sheet P on which an image has been thrilled is conveyed toward the sheet discharge section 31.

Figure 10A:
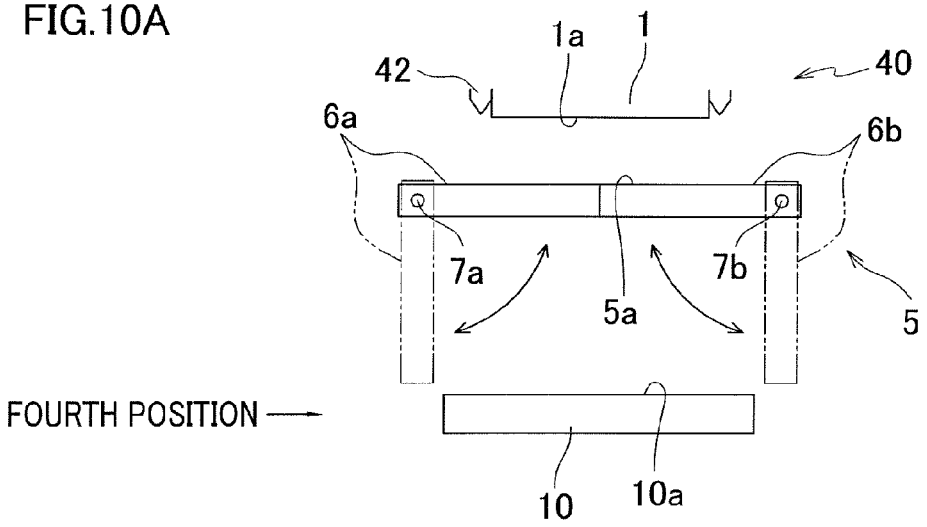
FIG. 10A illustrates the operations of the capping mechanism, the supporting mechanism, and the opposing member.
Figure 10B:
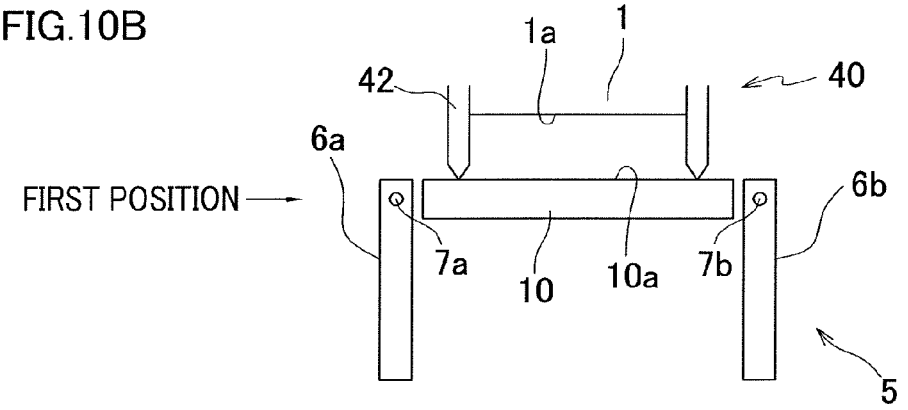
FIG. 10B illustrates the operations of the capping mechanism, the supporting mechanism, and the opposing member.

The supporting mechanism 5 supports the conveyed sheet P from below at the time of image formation. The supporting mechanism 5 includes two platens 6*a* and 6*b* and an unillustrated drive motor for moving them. The two platens 6*a* and 6*b* are provided in this order in the conveyance direction, and have rotational shafts 7*a* and 7*b* in the main scanning direction. The upstream platen 6*a* has its rotation center at its upstream end. The downstream platen 6*b* has its rotation center at its downstream end. Under the control of the control unit 100, the two platens 6*a* and 6*b* are rotated between a supporting surface forming position and an open position, as the drive motor is driven. At the supporting surface forming position, as shown in FIG. 1, the leading ends of the platens 6*a* and 6*b* are positioned to oppose each other, with the result that a planar supporting surface 5*a* is formed. At the open position, as shown in FIG. 10B, the two platens 6*a* and 6*b* extend downward after the rotation for 90 degrees, and the upper surfaces of the respective platens oppose each other in a parallel manner. The head 1 (ejection surface 1*a*) therefore directly opposes an opposing member 10 over the space. The opposing member 10 is elevatable. It is noted that the two platens 6*a* and 6*b* are at the supporting surface forming position in the normal operations, and are switched to the open position at the time of maintenance.

The sheet sensor 32 is disposed upstream of the feed roller pair 24 to detect the leading end of a conveyed sheet P. A detection signal output upon detection is used for synchronized driving of the head 1 and the conveyance mechanism 8, and therefore an image is formed with a desired resolution and speed. The moist air supply mechanism 50 supplies moist air to an ejection space S1 opposing the ejection surface 1*a*. In the ejection openings 108 open to the ejection space S1, moisture is supplied to the ink in the openings and hence the drying and the increase in the viscosity of the ink are restrained.

The head elevating mechanism 30 moves the head 1 between a printing position and a retracted position as the head holder 13 is moved up or down. At the printing position, as shown in FIG. 1, the head 1 is at the lower end of the movable range and opposes the platens 6*a* and 6*b* at the supporting surface forming position, with a gap suitable for printing. At the retracted position (see FIG. 13C), the head 1 is at the upper end of the movable range and is significantly separated from the platens 6*a* and 6*b*. A wiping position (see FIG. 13B) is between the printing position and the retracted position. At the wiping position and the retracted position, later-described wipers 36*a* and 36*b* are movable in the space between the head 1 and the opposing member 10.

Figure 13A:
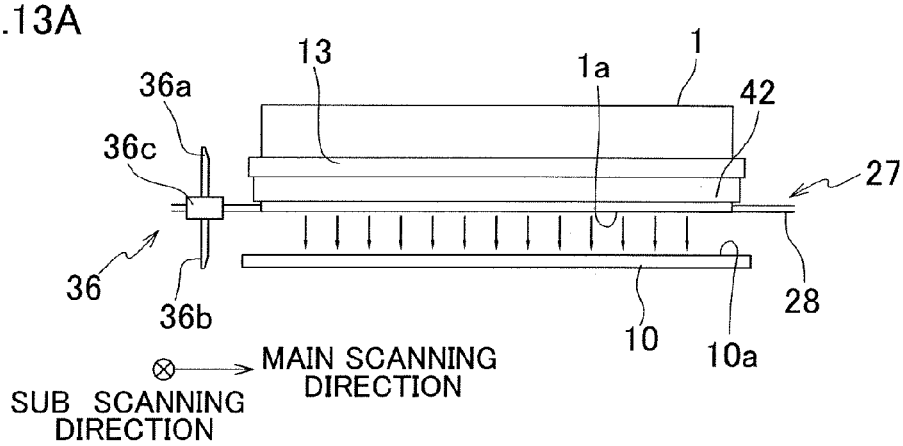
FIG. 13A illustrates first and second wiping operations.
Figure 13B:
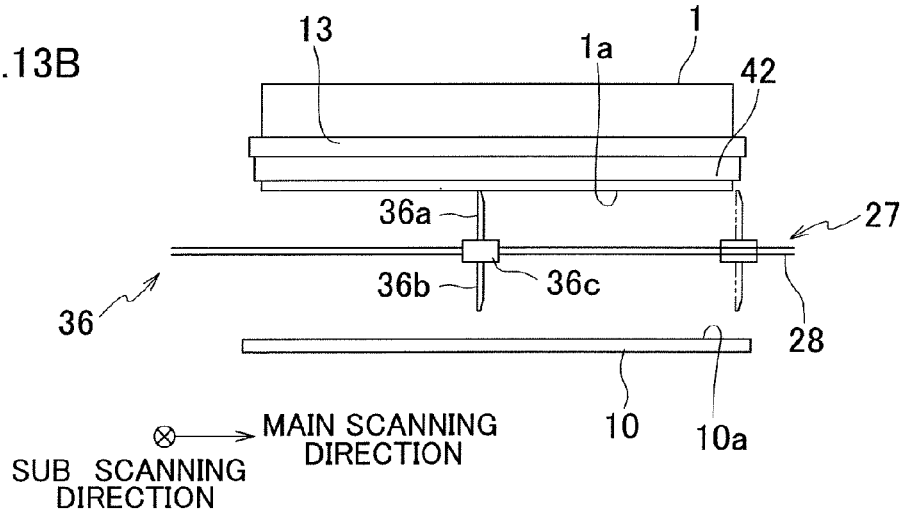
FIG. 13B illustrates the first and second wiping operations.
Figure 13C:
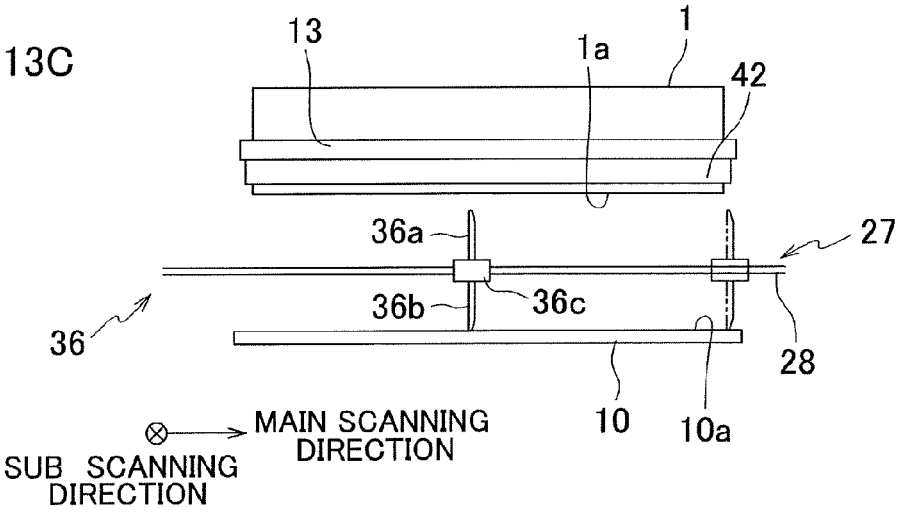
FIG. 13C illustrates the first and second wiping operations.

The wiper unit (wiping unit) 36 wipes, as shown in FIG. 13A to FIG. 13C, the ejection surface 1*a* and the surface 10*a* of the opposing member 10 along the main scanning direction. This wiper unit 36 includes two wipers 36*a* and 36*b*, and further includes a base portion 36*c* and a wiper moving mechanism 81 supporting the wipers 36*a* and 36*b*. The wiper 36*a* is vertically disposed on the upper surface side of the base portion 36*c* to wipe the ejection surface 1*a* (first wiping operation). The wiper 36*b* is vertically disposed on the lower surface side of the base portion 36*c* to wipe the surface 10*a* (second wiping operation). The wiper moving mechanism 81 is constituted by a pair of guides 82 and an unillustrated drive motor. As the drive motor is driven, the base portion 36*c* reciprocates along the guides 82. As shown in FIG. 13A, the standby position of the base portion 36*c* is around the left end of the head 1. In either wiping 110 operation, the wipers 36*a* and 36*b* wipe the surface while moving rightward in the figure. The base portion 36*c* returns the standby position after the head 1 moves to the retracted position and the opposing member 10 moves to a fourth position (described below).

In the space B is provided the sheet feeding section 1*c*. The sheet feeding section 1*c* has a sheet feeding tray 20 undo pickup roller 19. Among these components, the sheet feeding tray 20 is arranged to be detachable to the chassis 101*a*. The sheet feeding tray 20 is able to store a plurality of sheets P. The pickup roller 19 sends out the topmost one of the sheets P in the sheet feeding tray 20.

It is noted that the sub-scanning direction is a direction in parallel to the conveyance direction D (indicated by the arrow D FIG. 1) in which the sheet P is conveyed by the feed roller pairs 23 to 25, whereas the main scanning direction is in parallel to the horizontal plane and orthogonal to the sub-scanning direction.

In the space C, a cartridge 4 storing black ink is detachably attached to the chassis 101*a*. The cartridge 4 is connected to the head 1 via a tube (not illustrated) and a pump 88 (see FIG. 11). The pump 88 is driven when ink is forcibly supplied to the head 1 (i.e., at the time of purging and initial supply of a liquid). The pump 88 does not obstruct the supply of ink to the head 1 because it is out of action in cases other than the above.

Now, the control unit 100 will be described. The control unit 100 controls each component of the printer so as to control the overall operations of the printer 101. The control unit 100 controls an image formation operation based on a recording command (e.g., image data) input from an external apparatus (such as a PC connected to the printer 101). Upon receiving the recording command, the control unit 100 drives the sheet feeding section 1*c* and the guide units 9*a* and 9*b* (conveyance mechanism 8). The sheet P sent out from the sheet feeding tray 20 is guided by the upstream guide unit 9*a* and supplied to the supporting surface 5*a*. When the sheet P is passing through the position immediately below the head 1 in the sub-scanning direction (conveyance direction D), ink is ejected from the ejection surface 1*a* under the control of the control unit 100, with the result that a desired image is formed on the sheet P. Timings to eject ink are determined based on a detection signal from the sheet sensor 32. The sheet P on which the image has been formed is guided by the downstream guide unit 9*b* and is discharged from an upper part of the chassis 101*a* to the sheet discharge section 31.

The control unit 100 controls the maintenance operation in which the liquid ejection property of the head 1 is recovered or maintained and ejection of residual ink around the head is carried out. The maintenance operation includes operations such as purging and flushing operations, a first wiping operation (ejection surface wiping operation) for the ejection surface 1*a*, a second wiping operation (wiping operation) for the opposing member 10, a capping operation, a moisturization operation, and a residual ink ejection operation.

In the purging operation, the pump 88 is driven so that ink is forcibly supplied to all ejection openings 108. The actuators are not driven at this time. In the flushing operation, the actuators are driven so that ink is ejected through the ejection openings 108. The flushing operation is performed based on flushing data (which is different from image data).

The first wiping operation is carried out after the purging operation, and in this operation foreign matters such as ink remaining on the ejection surface 1*a* are removed (see FIG. 13B). The second wiping operation is performed each time an operation (the purging operation, the flushing operation, and the residual ink ejection operation) is performed, to remove foreign matters such as ink remaining on the surface 10*a* (see FIG. 13C).

Figure 6A:
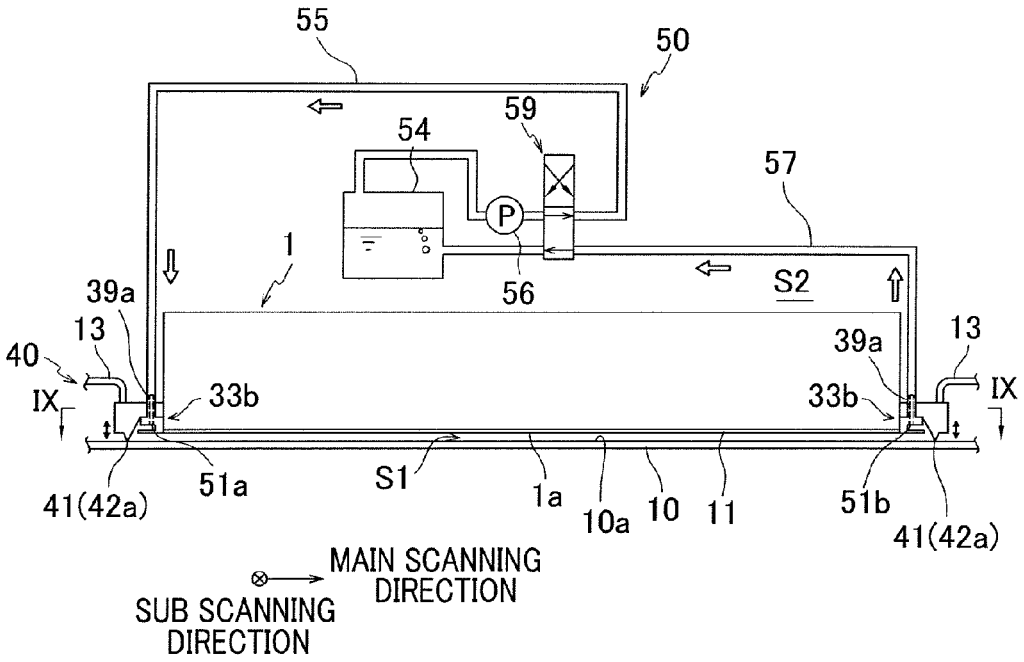
FIG. 6A schematically shows the head holder and the moist air supply mechanism in the printer of FIG. 1.
Figure 6B:
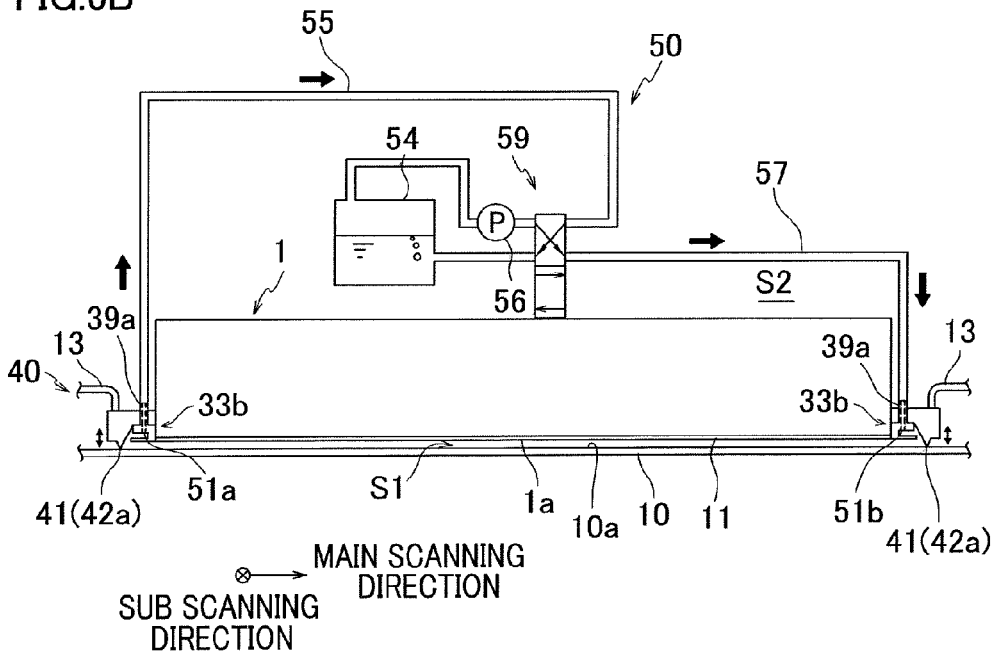
FIG. 6B schematically shows the head holder and the moist air supply mechanism in the printer of FIG. 1.

In the capping operation, as shown in FIG. 6A and FIG. 6B, the ejection space (opposing the ejection surface 1*a* (ejection openings 108)) S1 is arranged to be in the sealed state, i.e., arranged to be separated from the external space S2 by the cap 41. The moisture of the ink in the ejection openings 108 no longer move away and hence the increase in the viscosity and the drying are restrained.

In the moisturization operation, as shown in FIG. 6A and FIG. 6B, moist air is supplied to the isolated ejection space S1. Because water vapor stays inside the ejection space S1, the drying of the ink is further restrained. In the residual ink ejection operation, a first supplying operation and a second supplying operation both for supplying moist air are carried out. The first supplying operation is similar to the moisturization operation. As the moist air is supplied to the ejection space S1, the ink remaining in between a lip component 42 (described below) and the head 1 is moved toward the discharging slot. In the second supplying operation, the ejection space S1 is arranged to be in a released state (open state) and the moist air is supplied thereto. In so doing, the moist air is supplied through the discharging slot (opening 51*b*) in the first supplying operation. As a result, it is possible to eject, to the underlying opposing member 10 side, the residual ink having been gathered to the opening 51*b* side in the first supplying operation.

Now, a head main body 3 and a side cover 33 will be described with reference to FIG. 2 to FIG. 5, FIG. 7A, FIG. 7B, FIG. 8A, and FIG. 8B. For easier understanding, FIG. 3 depicts the pressure chambers 110, the apertures 112, and the ejection openings 108 by full lines even if they are below the actuator units 21.

Figure 2:
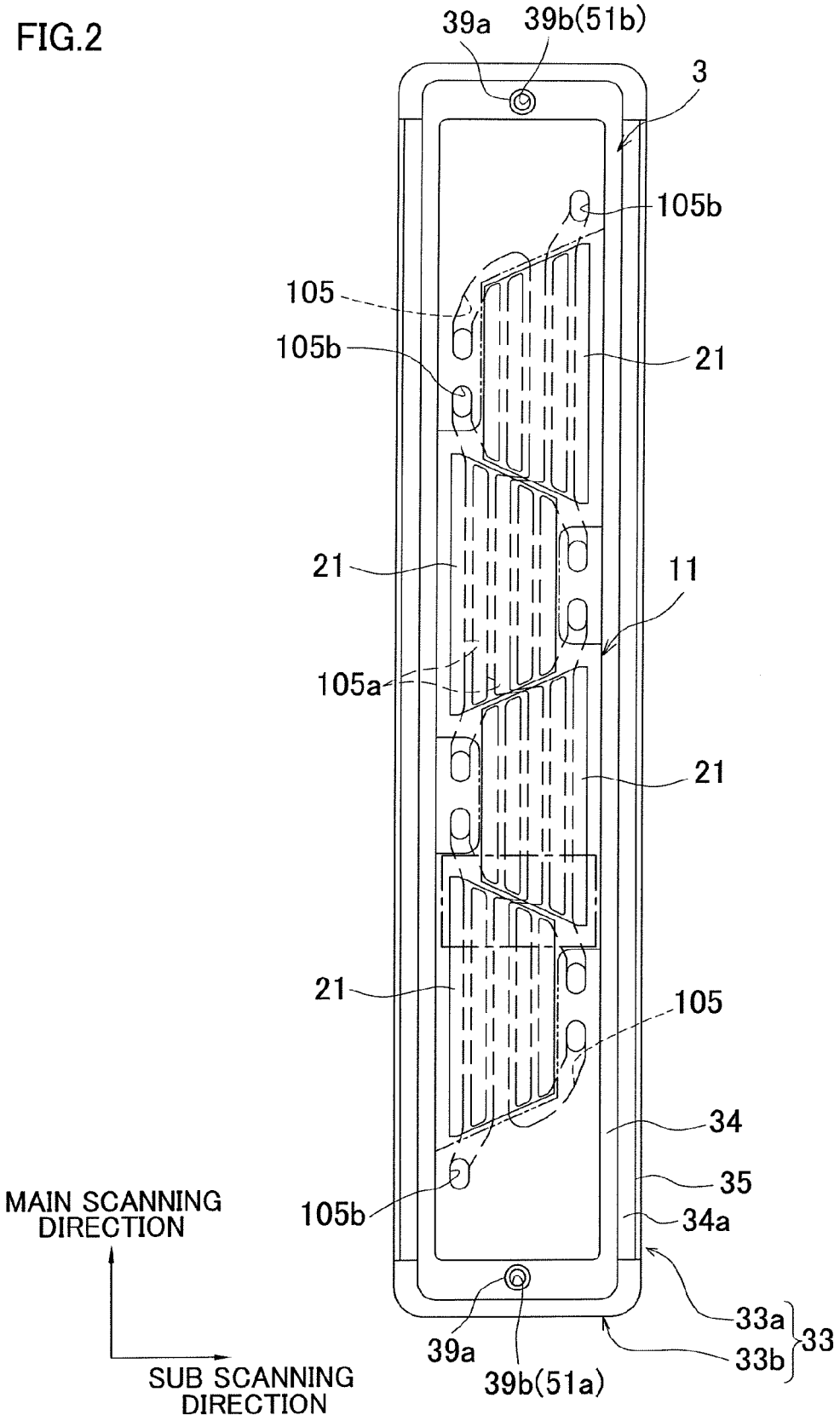
FIG. 2 is a plan view showing the head main body and the cover of a head in the printer of FIG. 1.
Figure 3:
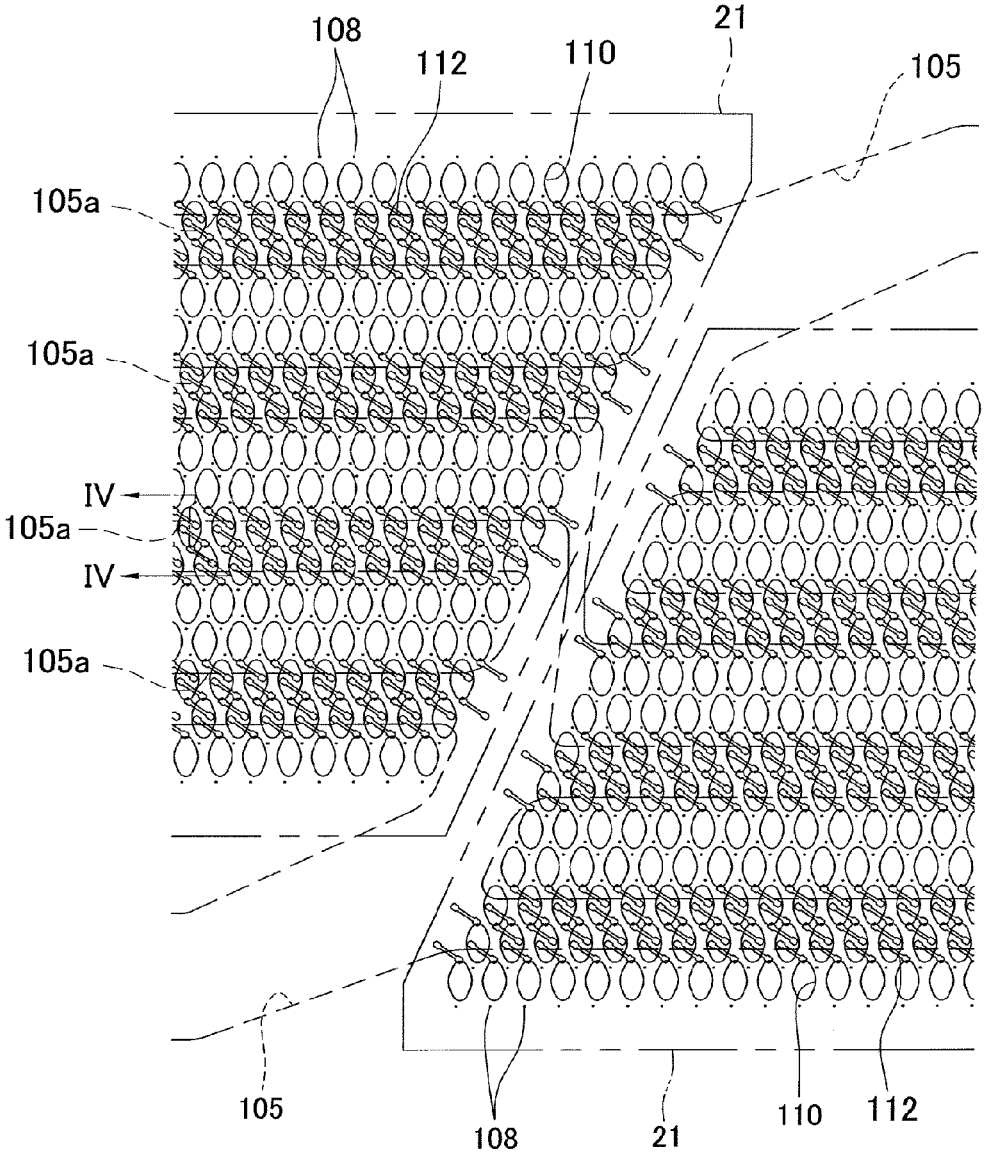
FIG. 3 is an enlarged view of the region enclosed by the dashed line in FIG. 2.

The head main body 3 is, as shown in FIG. 2, a laminated body in which four actuator units 21 are fixed to the upper surface of a passage unit 11. On the upper surface, pressure chambers 110 are formed as openings. The actuator units 21 seals these openings and form the side wall of each pressure chamber 110.

Figure 4:
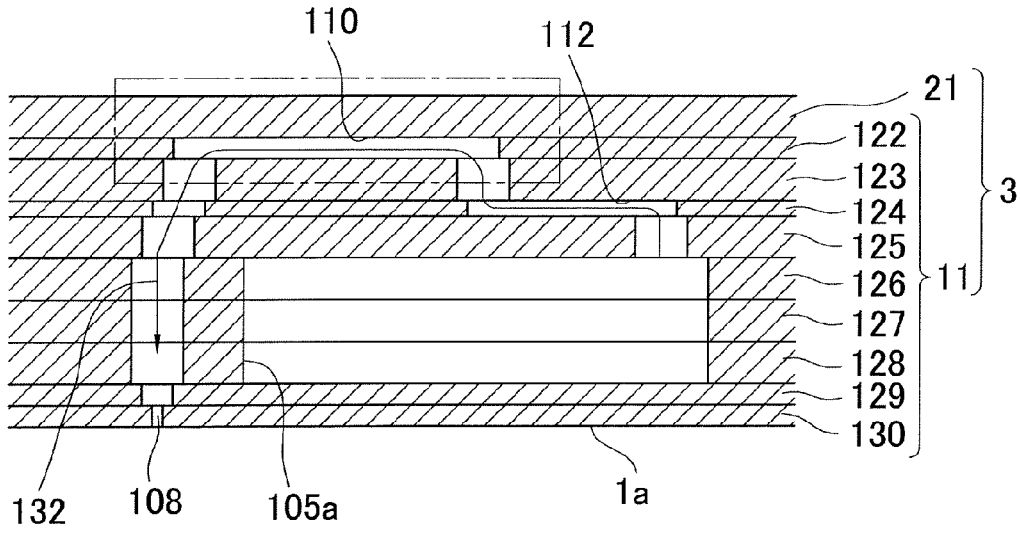
FIG. 4 is a partial cross section taken along the IV-IV line in FIG. 3.

As shown in FIG. 4, the passage unit 11 is a laminated body formed by laminating nine stainless steel plates 122 to 130. Inside the passage unit 11 is formed ink passages. Each ink passage is constituted by an upstream common ink passage and downstream individual ink flow passages 132. The common ink passage is constituted by a manifold passage 105 and sub-manifold passages 105*a* branching from the manifold passage 105. The manifold passage 105 has an upper-surface ink supply opening 105*b* at one end. Each individual ink flow passage 132 connects the outlet of the sub-manifold passage 105*a* with the ejection opening 108 on the lower surface (ejection surface 1*a*) via the aperture 112 and the pressure chamber 110. The ejection openings 108 are disposed on the ejection surface 1*a* at intervals corresponding to 600 dpi in the main scanning direction.

Figure 7B:
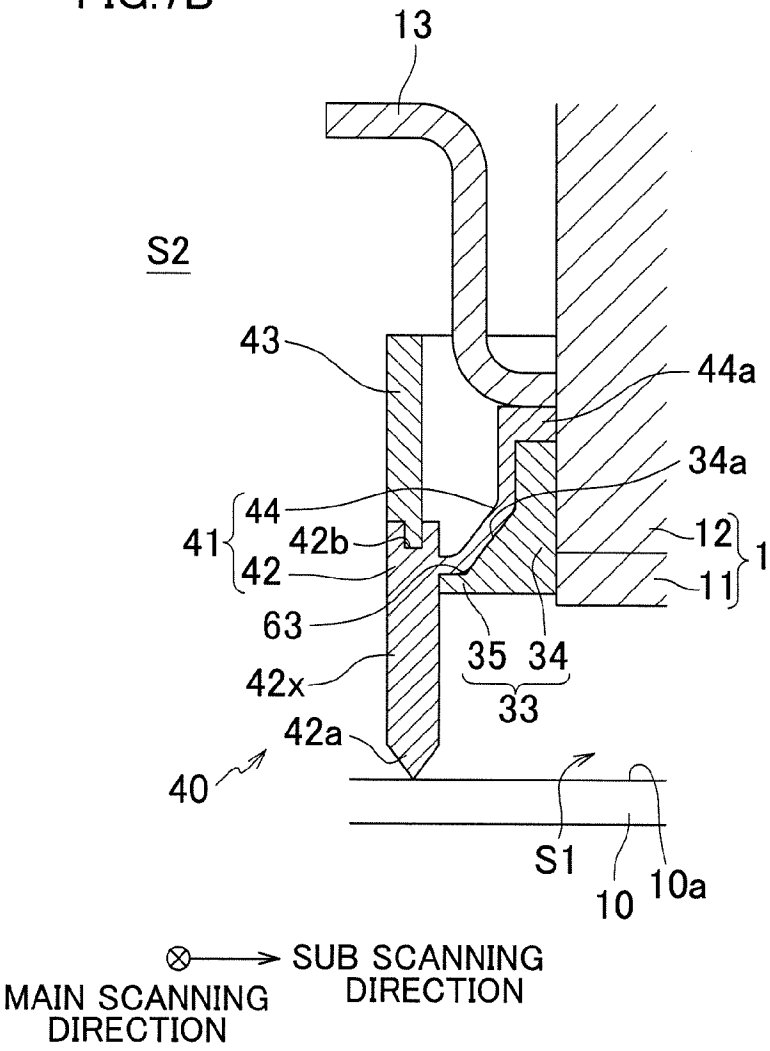
FIG. 7B is a partial cross section of the capping mechanism and the head taken along the main scanning direction, when the lip component is at the abutting position.
Figure 7A:
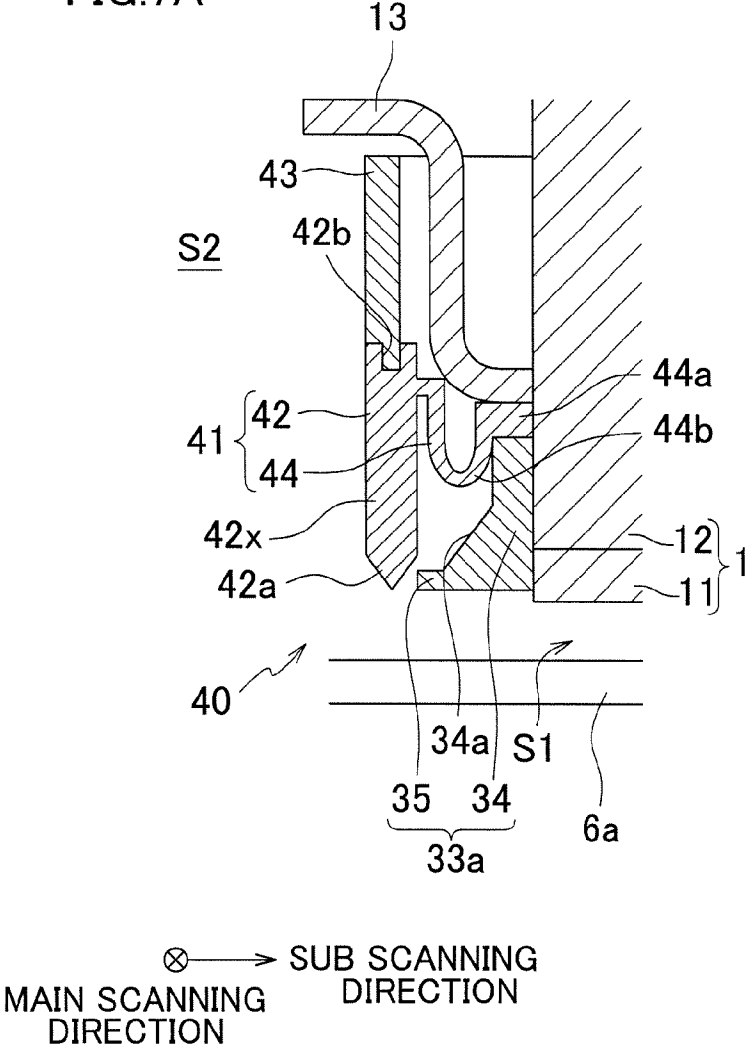
FIG. 7A is a partial cross section of the capping mechanism and the head taken along the main scanning direction, when the lip component is at the separated position.

The head 1 includes a side cover 33. The side cover 33 is, as shown in FIG. 2, an annular component entirely circumscribing the head main body 3. The side cover 33 is a molded product made of resin, and is attached to stretch across the side faces of the passage unit 11 and the reservoir unit 12 as shown in FIG. 7A and FIG. 7B. The side cover 33 includes attaching portions 34 and 37 and brim portions 35 and 38, and is constituted by long portions 33*a* extending along the main scanning direction and short portions 33*b* extending along the sub-scanning direction. The attaching portions 34 and 37 have attaching surfaces orthogonal to the ejection surface 1*a* and are fixed to the side faces of the head 1. The brim portions 35 and 38 are protrusions horizontally extending outward and are connected to the lower ends of the attaching portions 34 and 37. The lower surfaces of the brim portions 35 and 38 are farther from the platens 6*a* and 6*b* than the ejection surface 1*a* so as not to obstruct the conveyance of the sheet P.

Figure 8A:
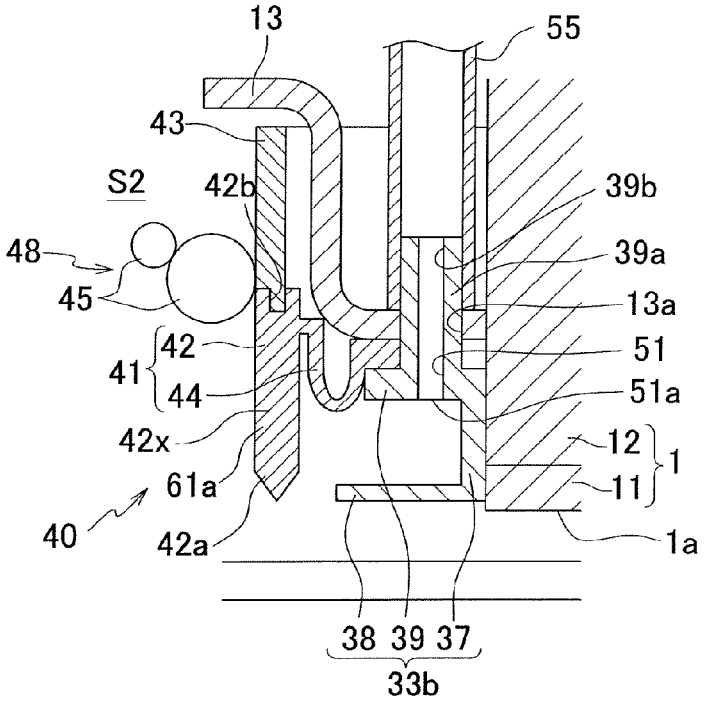
FIG. 8A is a partial cross section of the capping mechanism and the head taken along the sub-scanning direction, when the lip component is at the separated position.
Figure 8B:
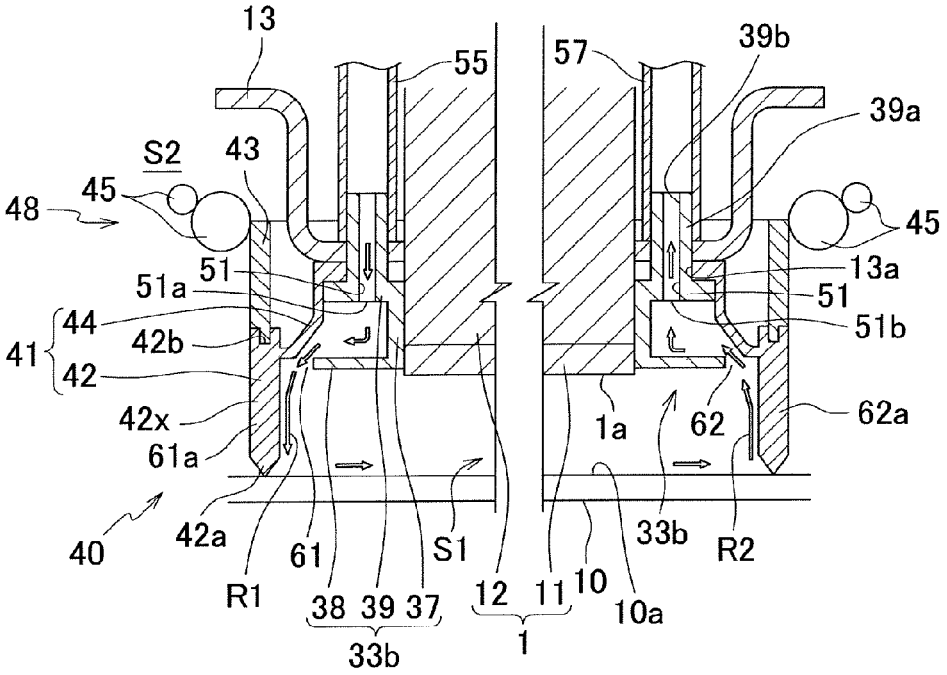
FIG. 8B is a partial cross section of the capping mechanism and the head taken along the sub-scanning direction, when the lip component is at the abutting position.

On each long portion 33*a*, as shown in FIG. 7A and FIG. 7B, a slope 34*a* is formed to slope from an upper part of the attaching portion 34 toward the leading end of the brim portion 35. The short portion 33*b* is substantially U-shaped in cross section, and is constituted by the attaching portion 37, the brim portion 38, and an upper protrusion 39 having a through hole 51 as shown in FIG. 8A and FIG. 8B. The upper protrusion 39 is a protrusion horizontally extending outward, and is connected to the upper end of the attaching portion 37. The degree of protrusion of the upper protrusion 39 is smaller than that of the brim portion 38. On the upper surface of the upper protrusion 39, a cylindrical connecting portion 39*a* extends upward at a central part in the sub-scanning direction, and a hollow part 39*b* of the connecting portion 39*a* is connected with the through hole 51. The lower opening 51*a* (51*b*) of the through hole 51 opposes the upper surface of the brim portion 38 and functions as an inlet (outlet) of the moist air into (from) the ejection space S1. As such, the side cover 33 constitutes a part of the side face of the head 1.

Now, the actuator units 21 will be described. As shown in FIG. 2, the four actuator units 21 are each trapezoidal in plan view and are staggered in the main scanning direction in such a way as to avoid the ink supply openings 105*b*. Furthermore, the horizontally opposing sides of each actuator unit 21 extend in the main scanning direction, and oblique sides of neighboring actuator units 21 overlap each other in the sub-scanning direction.

Figure 5:
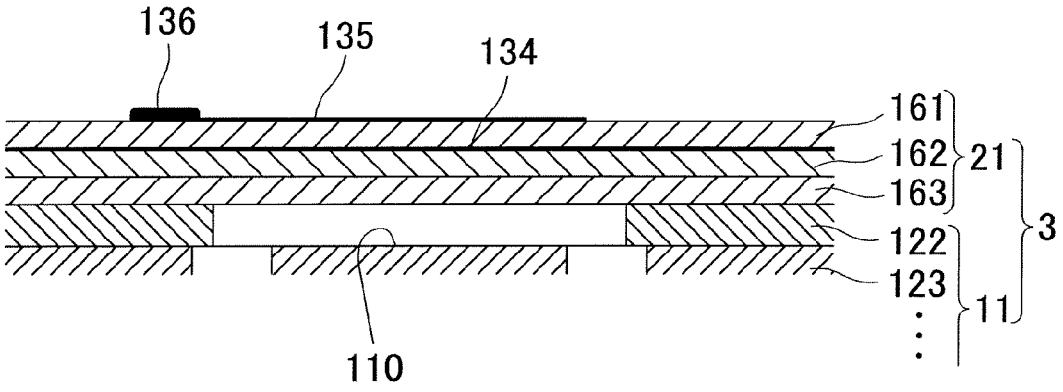
FIG. 5 is an enlarged view of the region enclosed by the dashed line in FIG. 4.

As shown in FIG. 5, each actuator unit 21 is made of lead zirconate titanate (PZT) ceramics having ferroelectricity and is composed of three piezoelectric layers 161 to 163. The topmost piezoelectric layer 161 has a plurality of individual electrodes 135 on its upper surface and is polarized in the thickness directions. On the entirety of the upper surface of the piezoelectric layer 162, a common electrode 134 is formed to be sandwiched between the piezoelectric layers 162 and 161. When an electric field in the polarization directions is generated between the electrodes 134 and 135, the piezoelectric layer 161 (drive active portion) therebetween contracts in the planar directions. Because the piezoelectric layers 162 and 163 do not actively deform, a difference in the degree of distortion is made between the piezoelectric layers 162 and 163 and the piezoelectric layer 161. As a result, the part sandwiched between the individual electrode 135 and the pressure chamber 110 protrudes toward the pressure chamber 110 (unimorph deformation). This pressurizes the ink in the pressure chamber 110, and hence an ink droplet is ejected.

As such, each actuator unit 21 has actuators for the respective individual electrodes 135, and each actuator is able to individually impart an ejection energy to the ink. In this connection, the common electrode 134 is always at the ground potential. Furthermore, the drive signal is selectively supplied from the individual land 136 to the individual electrode 135. The individual land 136 is provided at the leading end portion of the individual electrode 135.

In the present embodiment, ink ejection is achieved by "fill before fire" driving. Each individual electrode 135 is set at a predetermined electric potential in advance, and each actuator is unimorph-deformed. As the drive signal is input, the individual electrode 135 is set at the same electric potential as the common electrode 134 and then returns to the predetermined electric potential after a predetermined time elapses. At the timing to be set at the same electric potential, the actuator cancels the unimorph deformation and hence ink is sucked into the pressure chamber 110. At the timing to return to the predetermined electric potential, the actuator conducts the unimorph deformation again and an ink droplet is ejected through the ejection opening 108.

Now, referring to FIG. 6A to FIG. 8B, the structures of the head holder 13 and the capping mechanism 40 will be described.

The head holder 13 is a rigid frame made of metal or the like and entirely supports the side faces of the head 1. The head holder 13 is attached to the cap 41 of the capping mechanism 40. The cap 41 is also a part of the moist air supply mechanism 50. When the cap 41 forms a closed ejection space S1, the air in this space becomes replaceable with moist air.

In this connection, the interface between the head holder 13 and the head 1 is entirely sealed by a sealant. Furthermore, the interface between the head holder 13 and the cap 41 is entirely fixed by an adhesive. The head holder 13 has a through hole 13*a* corresponding to the short portion 33*b* of the side cover 33, and the upper protrusion 39 is inserted therethrough. The through hole 13*a* is sufficiently larger than the upper protrusion 39, and the gap between the through hole 13*a* and the upper protrusion 39 is filled with a sealant. On this account, paths through which the moisture escapes from the space S1 are certainly blocked when the cap 41 closes the ejection space S1.

Figure 11:
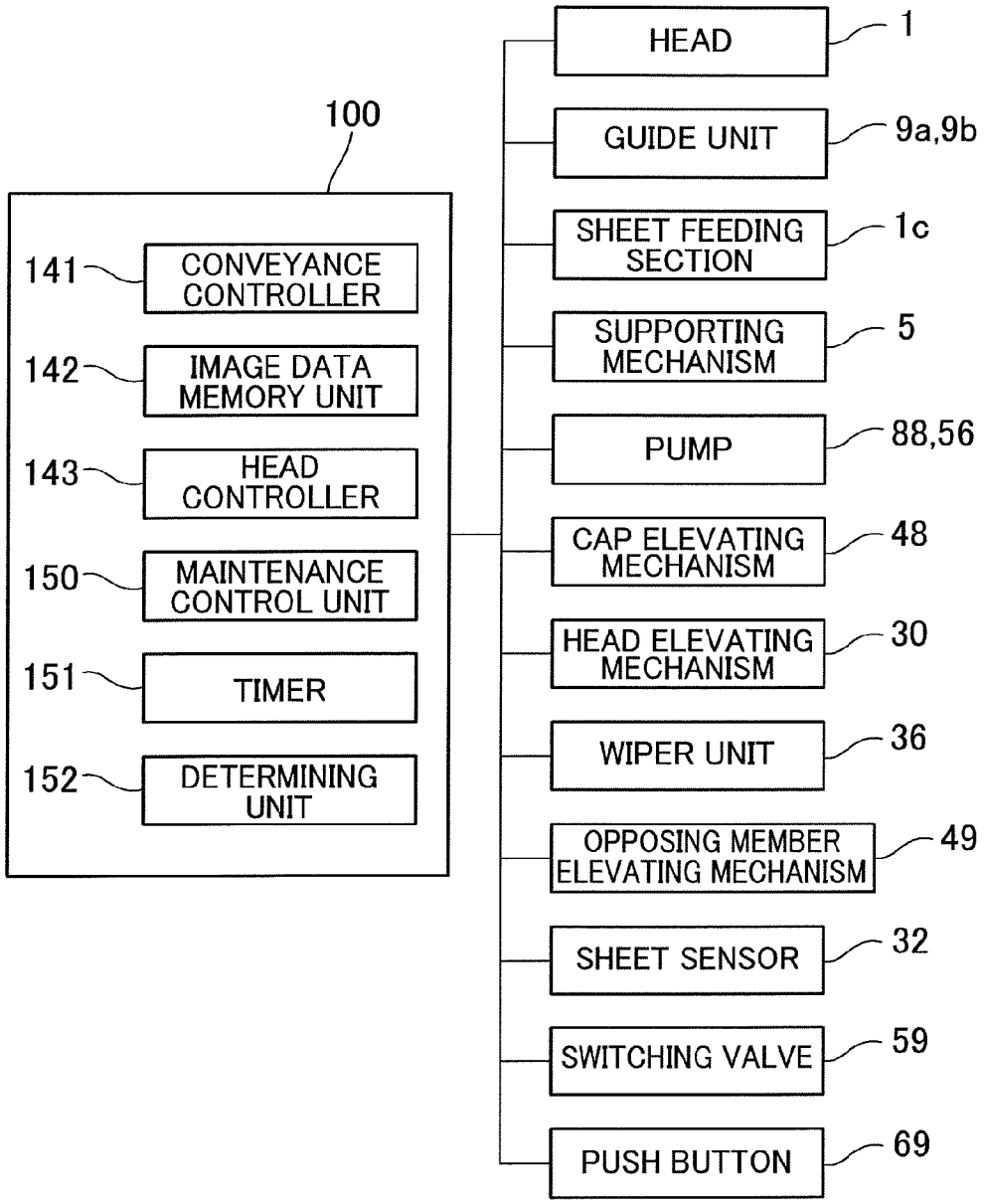
FIG. 11 is a functional block diagram of the control unit shown in FIG. 1.

The capping mechanism 40 includes the cap 41, a cap elevation mechanism 48 capable of moving up or down the cap 41, the opposing member 10, and an opposing member elevating mechanism 49 capable of moving up or down the opposing member 10 (see FIG. 11). The cap 41 is capable of enclosing therein the side cover 33 and the ejection space S1 in cooperation with the head 1 and is long in the main scanning direction. The cap 41 includes a lip component 42 and a diaphragm 44 as shown in FIG. 7A, FIG. 7B, FIG. 8A, and FIG. 8B.

The lip component 42 is an annular component made of an elastic material such as rubber, and encloses the head 1 in plan view. In other words, the lip component 42 is disposed outside the side cover 33. As shown in FIG. 7A and FIG. 7B, the lip component 42 includes a base portion 42*x* and a protrusion 42*a* protruding from the lower surface of the base portion 42*x*. The protrusion 42*a* is triangular in cross section. On the upper surface of the base portion 42*x* is formed a concave portion 42*b* which is fitted to the lower end of a later-described movable body 43.

The diaphragm 44 is also an annular component made of an elastic material such as rubber and encloses the head 1 in plan view. More specifically, the diaphragm 44 is a flexible thin film and is connected to the inner circumferential surface of the lip component 42 at an outer circumferential edge (one end). The lip component 42 and the diaphragm 44 are integrally formed. The inner circumferential edge of the diaphragm 44 functions as a closely-contacting portion 44*a*. In the closely-contacting portion 44*a*, the outer side face is the base portion of the thin film, the inner side face closely contacts the side face of the head 1, the upper surface closely contacts the lower surface of the head holder 13, and the lower surface closely contacts the upper end surface of the side cover 33. The upper surface of the closely-contacting portion 44*a* is entirely fixed to the head holder 13 by an adhesive.

The cap elevation mechanism (lip moving mechanism) 48 includes a movable body 43, a plurality of gears 45, and an elevating motor (not illustrated). The movable body 43 is an annular rigid component (made of stainless steel, for example) and encloses the head 1 from the outside of the side cover 33. The movable body 43 is connected to the gears 45. As the elevating motor is driven under the control of the control unit 100, the gears 45 rotate and the movable body 43 is moved up or down. The base portion 42*x* is moved up or down, too. As a result, the relative positions of the leading end of the protrusion 42*a* and the ejection surface 1*a* are changed in the vertical directions.

As the movable body 43 is moved up or down, the lip component 42 selectively takes an abutting position where its leading end (protrusion 42*a*) abuts to the surface 10*a* of the opposing member 10 (see FIG. 7B, FIG. 8B, and FIG. 10B) and a separated position where its leading end is separated from the surface 10*a* (see FIG. 7A and FIG. 8A). The abutting position is a position where the lip component 42 is able to abut to the surface 10*a* of the opposing member 10 at a later-described first position and the protrusion 42*a* is positioned to be in front of the ejection surface 1*a* in the ink ejection direction. At the separated position, the protrusion 42*a* is positioned to be behind the ejection surface 1*a* and the ejection space S1 is open to the external space S2 in a non-sealed state).

At the abutting position, the long portion of the lip component 42 extending along the main scanning direction contacts the leading end of the brim portion 35 at the inner circumferential surface, as shown in FIG. 7B. The diaphragm 44 contacts the upper surface of the side cover 33 with a small gap 63 being formed therebetween. As shown in FIG. 8B, the short portion 33*b* of the lip component 42 extending in the sub-scanning direction is separated from the leading end of the brim portion 35 together with the diaphragm 44, with a predetermined gap being formed therebetween. On the other hand, at the separated position, both of the long portion 33*a* and the short portion 33*b* are significantly separated from the leading end of the brim portion 35 as shown in FIG. 7A and FIG. 8A. The diaphragm 44 is also moved away from the side cover 33 by being curved to form a U-shape.

The opposing member 10 is a glass plate which is rectangular and sufficiently larger than the lip component 42 in plan view. The surface 10*a* is more hydrophilic than the surface of the lip component 42. On this account, the ink easily moves from the lip component 42 to the opposing member 10 when the lip component 42 abuts to the opposing member 10. The opposing member 10 may be made of a material different from glass on condition that a similar difference in the hydrophilicity is achieved.

Figure 10C:
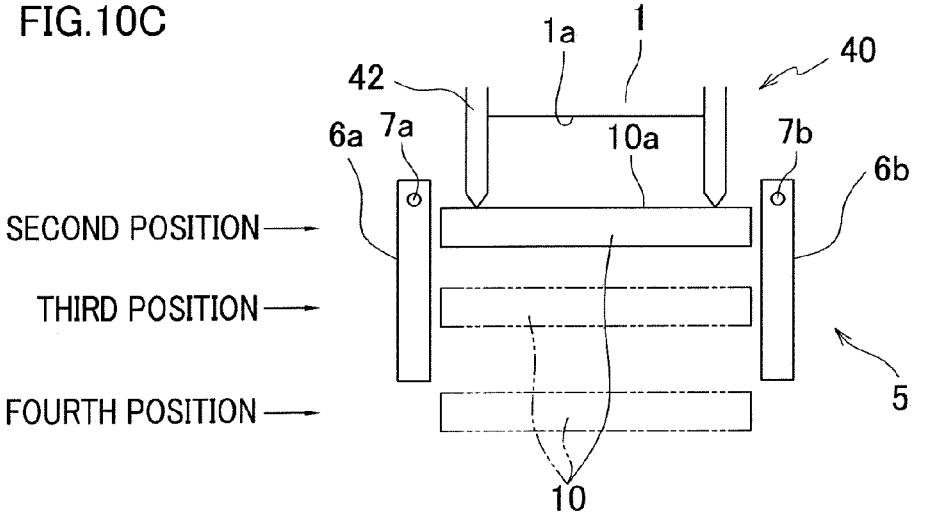
FIG. 10C illustrates the operations of the capping mechanism, the supporting mechanism, and the opposing member.

The opposing member elevating mechanism 49 moves up or down the opposing member 10, and the opposing member 10 is moved among the first position to the fourth position. The first position is, as shown in FIG. 10B, a position where the opposing member 10 is closest to the ejection surface 1*a*. This position corresponds to the abutting position of the lip component 42 and relates to the capping operation. In the present case, the separation distance between the surface 10*a* and the ejection surface 1*a* is arranged to be identical with the separation distance between the supporting surface 5*a* and the ejection surface 1*a* in printing. The second position is, as shown in FIG. 10C, a position where the separation distance between the surface 10*a* and the ejection surface 1*a* is longer than that of the first position. This position relates to the purging operation. The third position is a position where the separation distance is longer than that of the second position. This position corresponds to the retracted position of the head 1 and relates to the second wiping operation of the wiper 36*b*. The fourth position is a position where the separation distance is longer than that of the third position. This position corresponds to the wiping position of the head 1 and relates to the first wiping operation of the wiper 36*a*. The third position and the fourth position are indicated by two-dot chain lines in the figures. The fourth position is also a position where the opposing member 10 locates during the printing.

Now, referring to FIG. 6A and FIG. 6B, the structure of the moist air supply mechanism 50 will be described.

As shown in FIG. 6A and FIG. 6B, the moist air supply mechanism (supply unit) 50 includes components such as tubes 55 and 57, a switching valve 59, a pump 56, and a tank 54, in addition to the cap 41 and the pair of connecting portions 39*a*. One end of the tube 55 is fitted to the connecting portion 39*a* of the left short portion 33*b*, whereas the other end is connected to the tank 54. On the other hand, one end of the tube 57 is fitted to the connecting portion 39*a* of the right short portion 33*b*, whereas the other end is connected to the tank 54. As such, the tubes 55 and 57 connect the ejection space S1 with the tank 54.

The tank (generation unit) 54 stores water for moisturization in a lower space and stores moist air in an upper space. The tube 57 connected to the lower space (in the water) of the tank 54. On the other hand, the tube 55 is connected to the upper space of the tank 54. On the tube 55, a pump 56 is provided between the tank 54 and the switching valve 59. On the tube 57, furthermore, an unillustrated check valve is attached in the vicinity of the tank 54 to prevent the water in the tank 54 from flowing into the tube 57 side. When the amount of water remaining in the tank 54 becomes small, water is supplied to the tank 54 from an unillustrated water supply tank.

The switching valve 59 is provided to stretch over both tubes 55 and 57. Under the control of the control unit 100, the switching valve 59 is switchable to selectively take a first switching state at which the moist air in the tank 54 is supplied to the opening 51*a* (see FIG. 6A) or a second switching state at which the moist air in the tank 54 is supplied to the opening 51*b* (see FIG. 6B).

According to this arrangement, under the control of the control unit 100, as the put 56 is driven while the switching valve 59 is in the first switching state, the air in the tank 54 circulates along the outlined arrows in FIG. 6A. The moist air in the upper space of the tank 54 is supplied from the opening 51*a* to the ejection space S1. If the ejection space S1 is in the sealed state, the internal air flows toward the opening 51*b* while being replaced with the moist air. Because the tube 57 and the tank 54 are connected with each other in the water, the air in the ejection space S1 is humidified in the tank 54. The moist air generated in the tank 54 is supplied to the ejection space S1 until the driving of the pump 56 is stopped. On the other hand, under the control of the control unit 100, as the pump 56 is driven while the cap 41 is in the open state and the switching valve 59 is in the second switching state, as shown in FIG. 6B, the air in the tank 54 flows along the solid arrows. In this case, the moist air is supplied from the opening 51*b* to the ejection space S1 and the air sucked through the opening 51*a* is released into the water in the tank 54.

Figure 9:
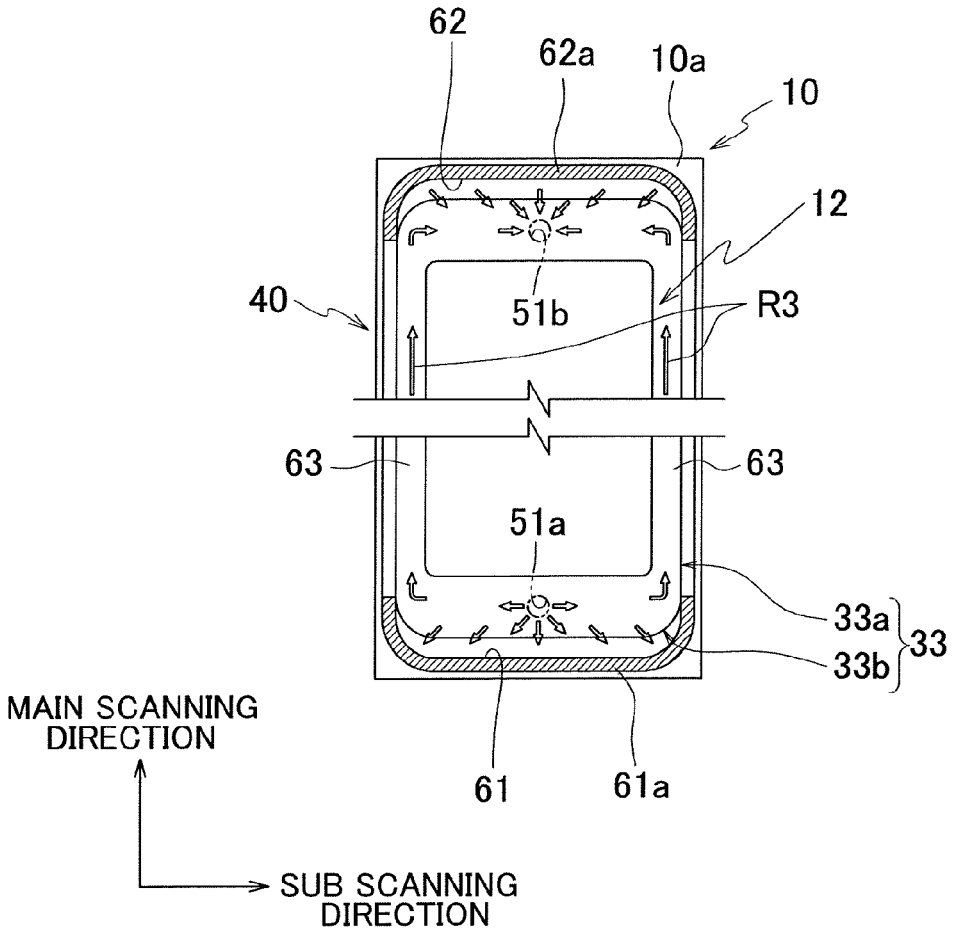
FIG. 9 is across section taken along the IX-IX line in FIG. 6A.

The brim portion 38 of the side cover 33 in the present embodiment is, as shown in FIG. 8B, arranged so that the outer edges in the main scanning direction oppose the first region 61*a* and the second region 62*a* of the lip component 42 with gaps 61 and 62 being interposed therebetween, respectively. These gaps 61 and 62 extend, as shown in FIG. 9, to reach the ends of the brim portion 38 in the sub-scanning direction. At these ends, the inner circumferential surface of the lip component 42 contacts the corner portions and their surroundings of the brim portion 38 when the ejection space S1 is in the sealed state. It is noted that the first region 61*a* is a region formed by one short side and the corners connecting this short side with the long sides in the rectangular lip component 42. The second region 62*a* is a region opposing the first region 61*a* in the main scanning direction and is identical in shape to the first region 61*a*. These first and second regions 61*a* and 62*a* are shown hatched in FIG. 9.

Now the air flow mainly inside the cap 41 will be described. In the sealed state, three paths are formed in the ejection space S1 in addition to the path formed by the ejection surface 1*a* and the opposing member 10, and moist air flows therethrough. The three paths are a first path R1 extending along the inner circumferential surface of the first region 61*a*, a second path R2 extending along the inner circumferential surface of the second region 62*a*, and a third path R3 between the diaphragm 44 and the upper surface of the side cover 33. The third path R3 is a gap 63 extending along the main scanning direction and connects the first path R1 with the second path R2.

As the pump 56 is driven, moist air flows into the ejection space S1 via the opening 51*a* as indicated by the outlined arrows in FIG. 8B. The moist air flows into the space from the entirety of the gap 61 which is narrow and is long in the sub-scanning direction, and the moist air flows toward the opening 51*b*. At the same time, a part of the moist air reaches the second path R2 via the third path R3. The moist air flowing in the second path R2 is ejected from the opening 51*b* via the gap 62. When the moist air is supplied from the opening 51*b* in the sealed state, the moist air flows in the direction opposite to the above. On the other hand, when the moist air is supplied from the opening 51*b* in the open state, the moist air is released toward the opposing member 10 via the second path R2, and the air in the external space S2 is sucked from the opening 51*a* via the first path R1. In so doing, no moist air flows through the third path R3.

Now, the control unit 100 will be described with reference to FIG. 11. The control unit 100 includes a CPU (Central Processing Unit), a ROM (Read Only Memory) rewritably storing programs executed by the CPU and data used by the programs, and a RAM (Random Access Memory) temporarily storing data when a program is executed. The functional blocks constituting the control unit 100 are constructed by the cooperation of the hardware above and software in the ROM. As shown in FIG. 11, the control unit 100 includes a conveyance controller 141, an image data memory unit 142, a head controller 143, a maintenance controller 150, a timer 151, and a determining unit 152.

Based on a recording command input from an external apparatus, the conveyance controller 141 controls the operations of the sheet feeding section 1*c* and the guide units 9*a* and 9*b* so that the sheet P is conveyed at a predetermined speed along the conveyance direction. The image data memory unit 142 stores image data (ink discharge data included in the recording command from the external apparatus.

The head controller 143 causes the head 1 to eject ink, onto the sheet P in image formation. In the image formation, the head controller 143 controls the ink ejection from the head 1 based on the image data stored in the image data memory unit 142. The control of the head 1 is carried out in sync with the conveyance of the sheet P based on a leading end detection signal indicating the detection of the leading end of the sheet P. The control based on image data starts after a predetermined time elapses from the detection of the leading end. In this regard, the leading end of the printing region of the sheet P reaches the position immediately below the most upstream ejection opening 108. The image formation encompasses dot formation based on flushing data. This dot formation is an operation to maintain ejection properties in the image formation, and may involve meniscus vibration.

The maintenance controller 150 controls the supporting mechanism 5, the head elevating mechanism 30, the wiper unit 36, the cap elevation mechanism 48, the opposing member elevating mechanism 49, the switching valve 59, and the pumps 56 and 88 in the maintenance operation including operations such as the purging operation, the flushing operation, the first wiping operation, the second wiping operation, the capping operation, the moisturization operation, and the residual ink ejection operation. In the flushing operation, the head 1 is controlled through the intermediary of the head controller 143.

The timer 151 measures time having elapsed from the previous residual ink ejection operation to the residual ink ejection operation. The timer 151 resets the elapsed time from the previous residual ink ejection operation when the residual ink ejection operation is carried out, and measures time elapses from this residual ink ejection operation.

The determining unit (output unit) 152 outputs a maintenance signal to start a maintenance operation including ejection of ink remaining around the head. The determining unit 152 determines whether predetermined conditions concerning time are satisfied at the power-on of the printer 101, and outputs the maintenance signal when the conditions are satisfied. Examples of the predetermined conditions include a case where the elapsed time measured by the timer 151 becomes equal to or longer than a predetermined time and a case where the elapsed time is not measured because the control unit 100 runs out the battery. In the former case, a problem of accumulation of ink on account of repeated wiping in the purging operation may occur. In the latter case, problems of unexpected ink leakage during an unmeasured time and contamination of the head and its surroundings on account of the ink leakage may occur. In the present embodiment, the predetermined time is 60 hours. The determination above is carried out when the printer 101 is powered on, and is a part of the preparation for printing.

The maintenance signal is output not only based on the predetermined conditions above but also when an instruction is made by the user. In the present embodiment, the printer 101 is provided with a push button 69. As the user pushes the button 69, the determining unit 152 outputs the maintenance signal. For example, when the head and its surroundings are contaminated on account of an unexpected incident, the sheet P after the image formation may be contaminated. In such a case, the user may push the button 69. In response to this, the maintenance operation is carried out after the completion of unfinished printing onto the sheet P, when successive printing is being carried out. The output of the maintenance signal by using the button 69 may be carried out at any time after the power on.

Figure 14:
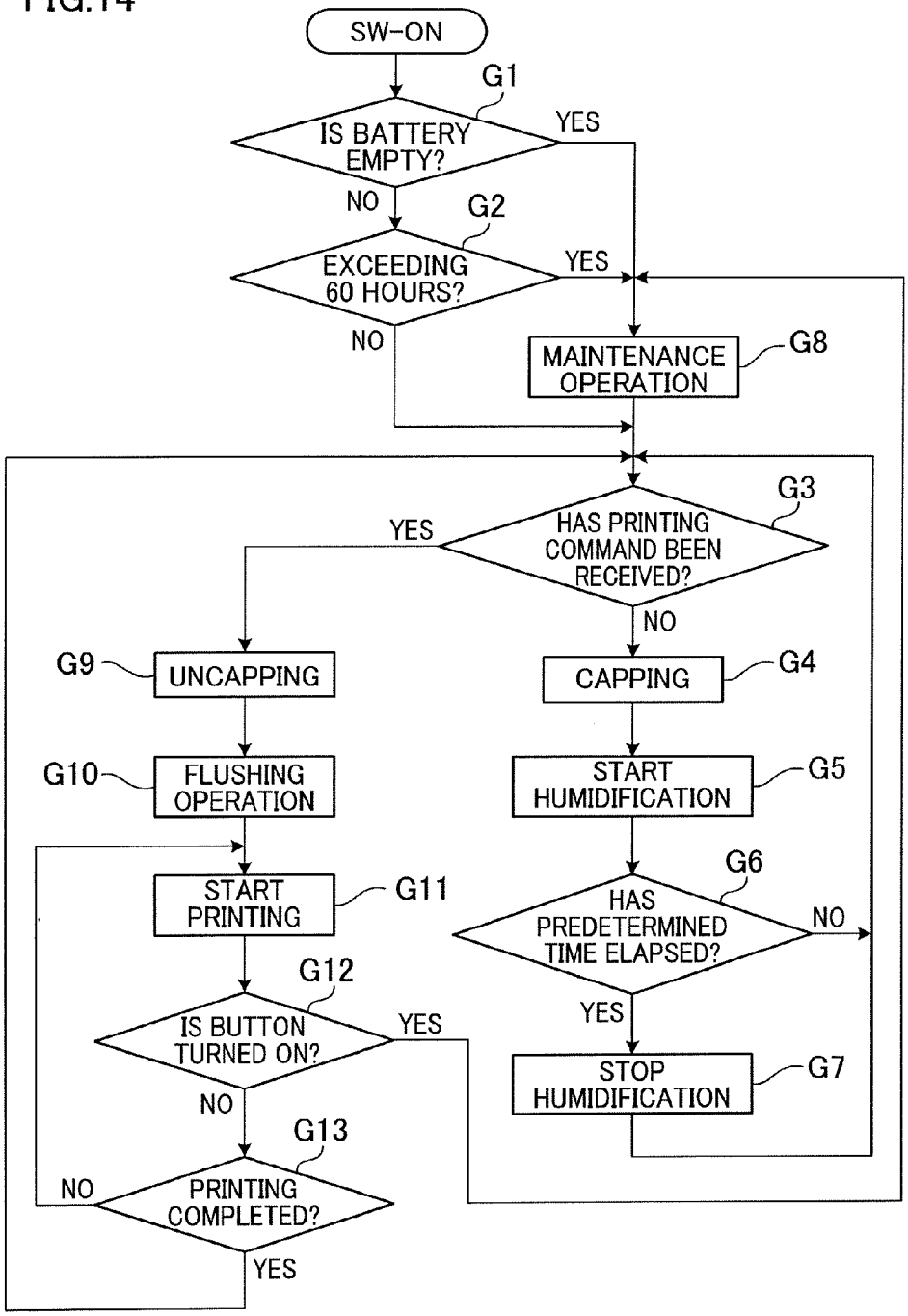
FIG. 14 is a flowchart of a flow of the operation steps of a maintenance operation executed by the control unit of the printer of FIG. 1.

Now, the operation steps of the maintenance operation above will be briefly described with reference to FIG. 14. These steps constitute a standby operation of the printer 101 immediately after the power on (SW-ON).

In the step G1, the determining unit 152 determines whether the control unit 100 runs out the battery. Whether the battery is empty is determined by determining whether the timer 151 has received elapsed time information. When the battery is empty, it is not possible to obtain proper elapsed time information. When the battery is empty (G1: Yes), the process shifts to the step G8 for the maintenance operation on account of a possibility of unexpected contamination of the head and its surroundings. When the battery is not empty (G1: No), the process shifts to the step G2.

In the step G2, the determining unit 152 determines whether time elapsed from the previous maintenance operation (residual ink ejection operation) is not shorter than a predetermined time (e.g., 60 hours). When the elapsed time is not shorter than the predetermined time (G2: Yes), the process shifts to the step G8 for the maintenance operation on account of a possibility of unexpected contamination of the head and its surroundings. When the elapsed time is shorter than the predetermined time (G2: No), the process shifts to the next step G3.

In the step G3, the control unit 100 determines whether a printing command has been input. If the printing command has been input at this stage (G3: Yes), the process shifts to the step G9 and preparation to start printing starts. If no printing command has been input (G3: No), the operation is on standby until the input. In the present embodiment, the moisturization operation is carried out during the standby to restrain the increase in the viscosity and the drying of ink during the standby.

To begin with, the step G4 is executed. The maintenance controller 150 performs the capping of the ejection surface 1*a* by controlling the supporting mechanism 5, the head elevating mechanism 30, the cap elevation mechanism 48, and the opposing member elevating mechanism 49. As a result, the ejection space S1 becomes in the sealed state. Because the ejection space S1 is in the sealed state immediately after the power on, no changes appear to be made. In the meanwhile, after the maintenance operation in the step G8, the lip component 42 is moved from the separated position to the abutting position. After the completion of the printing in the step G13, the lip component 42 is similarly moved, too.

The operation then shifts to the step G5 and the circulation of the moist air starts. The maintenance controller 150 controls the pump 56 and the switching valve 59 to supply the moist air through the opening 51*a*. The circulation operation of the moist air is performed only for a predetermined time (e.g., one to five minutes, and three minutes in this case). The pressure to supply the moist air applied by the pump 56 is arranged to be equal to or lower than the maximum pressure with which the meniscus of the ejection opening 108 is not broken (meniscus-resisting pressure). If the printing command is input during the moisturization, the operation shifts from the step G3 to the step G9 (G6: No). After the predetermined time elapses (G6: Yes), the circulation of the moist air is stopped and the sealed state is maintained (step G7). The drying of the ink in the cap 41 is therefore restrained.

As a variation, the moist air may be supplied from the opening 51*b* in the moisturization operation above. The effect of restraining the drying of the ink in the cap 41 is similarly achieved in this case, too.

In the step G8, a maintenance operation involving a residual ink ejection operation is executed. Details of this operation will be given later. As the maintenance operation is completed, the process shifts to the step G3 and a printing operation or a standby operation is executed.

In the step G9, the ejection space S1 is switched to the open state as a preparation for a printing operation. The maintenance controller 150 controls the cap elevation mechanism 48 and the opposing member elevating mechanism 49 to open the ejection surface 1*a*. In doing so, in consideration of the next flushing operation, the opposing member 10 is disposed at a second position shown in FIG. 10C. The cap 41 (lip component 42) is returned from the abutting position to the separated position. After the movement of the components is completed, the process shifts to the step G10.

In the step G10, the flushing operation is executed. The flushing operation includes ink ejection to the surface 10*a* of the opposing member 10 and ink removal from the surface 10*a*. In cooperation with the head controller 143, the maintenance controller 150 ejects a predetermined number of ink droplets from all ejection openings 108. The target of the ejection of the ink droplets in this case is the surface 10*a*. In addition to the ink ejection, meniscus vibration may be performed for a predetermined number of times. After the ink ejection, the maintenance controller 150 controls the head elevating mechanism 30, the wiper unit 36, and the opposing member elevating mechanism 49 so as to perform a second wiping operation. Prior to the wiping, the head 1 is moved to the retracted position and the opposing member 10 is moved to the third position, with the result that the ejection space S1 is switched to the open state. After the wiping, in consideration of the next printing operation, the head 1 is moved to the printing position and the opposing member is moved to the fourth position. Furthermore, the platens 6*a* and 6*b* are rotated from the open position to the supporting surface forming position.

In the step G11, the control unit 100 controls the conveyance controller 141 and the head controller 143 so as to start the conveyance of the sheet P and the ink ejection in sync with the conveyance. Based on the image data stored in the image data memory unit 142, printing onto the sheet P is carried out.

In the step G12, the determining unit 152 monitors a user's request for the maintenance operation (i.e., an action of pushing the button 69). This monitoring continues until the completion of the printing operation. When the maintenance operation is requested (G12: Yes), the determining unit 152 outputs a maintenance signal and the process shifts to the step G8. On the other hand, when such a request is not made (G12: No), the printing operation is continued.

In the step G13, the control unit 100 determines whether the printing instructed by the printing command has been finished, if there is a sheet P to be printed next (G13: No), the operation returns to the step G11 and a new sheet P is sent out and printing thereon is carried out. If there is no more sheet P to be printed (G13: Yes), the process shifts to the step G3 and input of the next printing command is waited for. In the present embodiment, at this stage, after the step G4 to step G7 are carried out once, the operation is on standby in the capped state.

Figure 12:
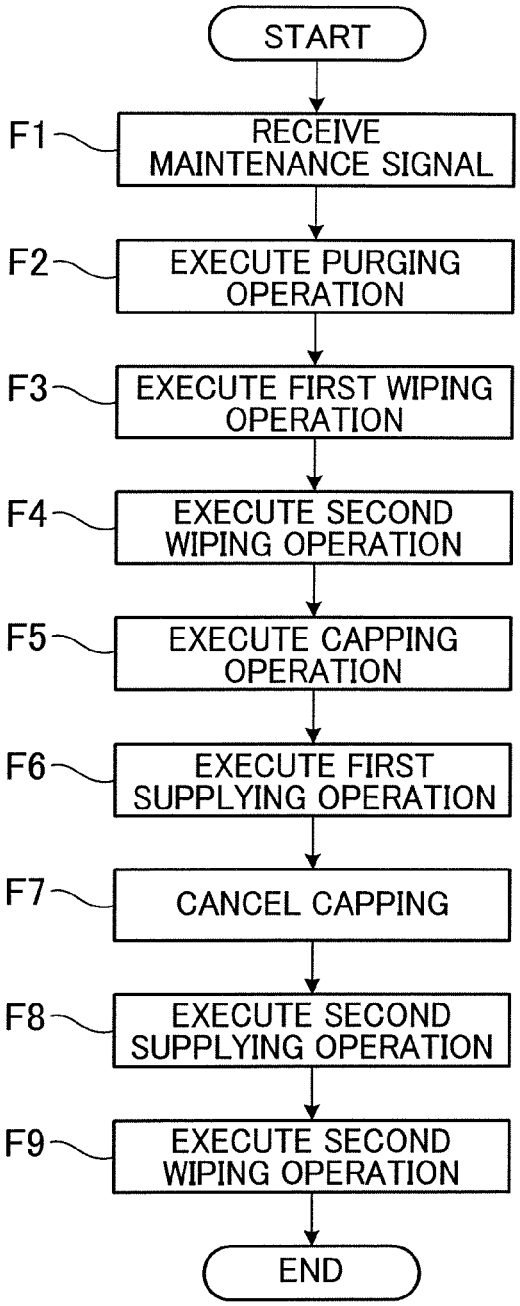
FIG. 12 is a flowchart of a flow of the operation steps of a maintenance operation executed by the control unit of the printer of FIG. 1.

Subsequently, an example of the maintenance operation in the step G8 will be described with reference to FIG. 12.

The control unit 100 receives a maintenance signal from the determining unit 152 (F1). Subsequently, in the step F2, the control unit 100 controls the purging operation.

In the step F1, the ejection space S1 is in the sealed state when a maintenance signal is received based on the elapsed time information. At this stage, the platens 6*a* and 6*b* are at the open position, the opposing member 10 is at the first position, the head 1 is at the printing position, and the lip component 42 is at the abutting position. On the other hand, the ejection space S1 may be in the open state when a maintenance signal is received from the push button 69. For example, when the signal is received during the printing, the platens 6*a* and 6*b* are at the supporting surface forming position, the opposing member 10 is at the fourth position, the head 1 at the printing position, and the lip component 42 is at the separated position. For this reason, when executing the purging operation, the maintenance controller 150 controls the cap elevation mechanism 48 and the opposing member elevating mechanism 49 so as to move the lip component 42 to the separated position and move the opposing member 10 to the second position as shown in FIG. 13A, when the ejection space S1 is in the sealed state. On the other hand, when the ejection space S1 is in the open state, the maintenance controller 150 controls the supporting mechanism 5 and the opposing member elevating mechanism 49 so as to move the platens 6*a* and 6*b* to the open position and then, as shown in FIG. 13A, move the opposing member 10 to the second position (liquid ejection position). Thereafter, the maintenance controller 150 controls the pump 88 so as to supply ink to the head 1 by pressure urging operation). The purging operation in the present embodiment is performed such that a predetermined amount of ink in the cartridge 4 is forcibly supplied to the head 1 and the liquid is ejected through the ejection openings 108.

Subsequently, the first wiping operation is executed in F3. In so doing, the maintenance controller 150 controls the head elevating mechanism 30 and the opposing member elevating mechanism 49 no as to move the head 1 to the wiping position and move the opposing member 10 to the fourth position. Thereafter, the maintenance controller 150 controls the wiper unit 36 (wiper moving mechanism 81) so as to wipe, as shown in FIG. 13B, the ejection surface 1*a* by the wiper 36*a* (first wiping operation).

In so doing, the ejection surface 1*a* is wiped in the direction from the opening 51*a* side to the opening 51*b* side. This direction of the wiping is identical with the direction of air flow in the later-described step F6 (first supplying operation). For this reason, the residual ink after the wiping by the wiper 36*a* is gathered to the second region 62*a* side. With this, the ink ejection capability in the second supplying operation in the later-described step F8 is improved.

Furthermore, at this stage, the wiper 36*a* is moved from the standby position to a position vertically opposing the second region 62*a* of the lip component 42 (i.e., a corner portion opposing the second path R2 of the brim portion 38), as indicated by the two-dot chain line in FIG. 13B. With this, the ink adhering to the ejection surface 1*a* and the lower surface of the brim portion 38 is wiped away by the wiper 36*a* and the ink is moved to around the second path R2. This improves the ink ejection capability in the second supplying operation. After this first wiping operation, the maintenance controller 150 controls the head elevating mechanism 30 and the wiper unit 36 to move the head 1 to the retracted position and then return the base portion 36*c* (wipers 36*a* and 36*b*) to the standby position.

Subsequently, the second wiping operation is executed in the step F4. In so doing, the maintenance controller 150 controls the opposing member elevating mechanism 49 so as to move the opposing member 10 to the third position. Thereafter, the maintenance controller 150 controls the wiper unit 36 (wiper moving mechanism 81) to wipe, as shown in FIG. 13C, the surface 10*a* by the wiper 36*b* (second wiping operation). After this second wiping operation, the maintenance controller 150 controls the opposing member elevating mechanism 49 and the wiper unit 36 so as to move the opposing member 10 to the fourth position and then return the base portion 36*c* (wipers 36*a* and 36*b*) to the standby position. Thereafter, the maintenance controller 150 controls the head elevating mechanism 30 so as to move the head 1 to the printing position.

Subsequently, the capping operation is executed in the step F5. In so doing, the maintenance controller 150 controls the opposing member elevating mechanism 49 and the cap elevation mechanism 48 so as to, as shown in FIG. 10B, move the opposing member 10 to the first position and then move the lip component 42 to the abutting position. With this, the ejection space S1 is switched to the sealed state.

Subsequently, the first supplying operation is executed in the step F6. The maintenance controller 150 controls the switching valve 59 and the pump 56 so as to drive the pump 56 for a predetermined time in the first switching state. At the same time, the maintenance controller 150 controls the pump 56 so that the pressure to supply moist air from the opening 51*a* is equal to or lower than the resisting pressure of ink meniscus, which is the maximum pressure with which the ink meniscus formed at the ejection openings 108*a* is not broken. This prevents the moist air from entering the ejection openings 108 as bubbles. As such, the moist air supplied from the opening 51*a* passes through the first path R1, the space between the opposing member 10 and the ejection surface 1*a*, and the second path R2 in this order and is then ejected through the opening 51*b*. A part of the supplied moist air reaches the second path R2 via the third path R3. On account of this flow of the moist air, the residual ink at the gap 63 (between the lip component 42 and the head 1) is moved from the opening 51*a* side to the opening 51*b* side.

Subsequently, the capping is canceled in the step F7. In so doing, the maintenance controller 150 controls the opposing member elevating mechanism 49 so as to, as shown in FIG. 10C, move the opposing member 10 to the second position (liquid ejection position). As a result, the open state is established while the lip component 42 is at the abutting position.

Subsequently, the second supplying operation is executed in the step F8. In so doing, the maintenance controller 150 controls the switching valve 59 and the pump 56 so as to drive the pump 56 for a predetermined time in the second switching state. With this, moist air is supplied, from the opening 51*b* and the air in the external space S2 is sucked through the opening 51*a*. On account of the moist air supplied from the opening 51*b*, the ink having been gathered to the opening 51*b* side in the ejection surface wiping operation and the first supplying operation is ejected through the second path R2 to the opposing member 10 side. Because in this state the opposing member 10 is at the second position where the opposing member 10 is farther from the ejection surface 1*a* than the first position, the waste ink on the surface 10*a* is not scattered by the wind pressure of the moist air. Furthermore, the ink around the opening 51*b* does not return the opening 51*a* side via the third path R3.

In the state above, furthermore, the maintenance controller 150 controls the pump 56 so that the pressure to supply the moist air from the opening 51*b* is higher than the resisting pressure of the ink meniscus. In other words, the pressure to supply the moist air in the second supplying operation is higher than the pressure in the first supplying operation. This makes it possible to effectively eject the ink having been gathered to the opening 51*b* side to the opposing member 10 side. The driving time of the pump 56 in the step F8 is therefore shortened.

Subsequently, the second wiping operation is executed for the second time in the step F9. This operation is different from the second wiping operation for the first time (step F4) in the wiping range on the surface 10*a*. In the second time, the wiping starts at a non-edge part of the surface 10*a* and is continued toward the opening 51*b* side. The wiping ends at a position outside the opposing region of the second region 62*a* in the main scanning direction. To begin with, the maintenance controller 150 controls the head elevating mechanism 30 and the cap elevation mechanism 48 so as to move the head 1 to the retracted position and move the lip component 42 to the separated position. Thereafter, the maintenance controller 150 controls the opposing member elevating mechanism 49 and the wiper unit 36 so as to move the opposing member 10 to the fourth position, and then move the base portion 36*c* so that the wiper 36*b* opposes a central part in the main scanning direction of the surface 10*a* of the opposing member 10. Subsequently, the opposing member 10 is moved to the third position to cause the wiper 36*b* to contact the surface 10*a* as shown in FIG. 13C. Then the wiper 36*b* is moved to the position indicated by the two-dot chain line in FIG. 13C to wipe the surface 10*a* (second wiping operation).

With this, no ink remains inside the region of the opposing member 10 defining the ejection space S1. In the sealed state, the ink around the ejection openings is less likely to be dry. Furthermore, the life of the wiper 36*b* is elongated because the length of redundant wiping by the wiper 36*b* is short.

To perform the printing operation after the second wiping operation above, the maintenance controller 150 controls the opposing member elevating mechanism 49 and the wiper unit 36 to move the opposing member 10 to the fourth position and then return the base portion 36*c* (wiper 36*a* and 36*b*) to the standby position. Thereafter, the maintenance controller 150 controls the head elevating mechanism 30 to move the head 1 to the printing position.

On the other hand, to perform the standby operation after the second wiping operation, the maintenance controller 150 controls the head elevating mechanism 30, the opposing member elevating mechanism 19, and the wiper unit 36 so as to return the base portion 36*c* to the standby position in the same manner as in the case of the printing operation and then move the head 1 to the printing position and return the opposing member 10 from the fourth position to the first position.

As a variation, in the step F9, after the head 1 is moved to the retracted position, the lip component 42 is moved to the separated position, and the opposing member 10 is moved to the third position, the entirety of the surface 10*a* may be wiped by the wiper 36*b*. The operations before wiping the surface 10*a* are simplified, in this case and hence the time required for the second wiping operation is shortened.

In this way, the maintenance operation is finished.

It is noted that the flushing operation may be performed instead of the purging operation. In such a case, ink droplets are ejected from the head 1 to the surface 10*a* of the opposing member 10, and then the second wiping operation is executed to remove the ink droplets from the surface 10*a*. The wiping operation for the ejection surface 1*a* is not executed in this case.

As described above, the primer 101 of the present embodiment is arranged such that, upon receiving the maintenance signal, the moist air is supplied in two stages, namely in the first supplying operation and in the subsequent second supplying operation. In the first supplying operation, airflow from the opening 51*a* toward the opening 51*b* is generated, and the ink around the head is moved to the opening 51*b* side. In the second supplying operation, airflow from the opening 51*b* toward the surface 10*a* is generated and the ink on the opening 51*b* side is ejected to the surface 10*a*. The sealed state is established after the ink is wiped away from the surface 10*a*. As such, the ink is less likely to remain in the ejection space S1 in the sealed state, and hence the ink around the ejection openings is less likely to be dried.

Furthermore, after the second supplying operation and before the second wiping operation, the opposing member 10 is switched from the second position to the third position. This makes it easy to wipe the surface 10*a* of the opposing member 10.

Furthermore, because the moist air supply mechanism 50 is provided with the tank 54 for generating moist air, the moist air is supplied from the openings 51*a* and 51*b* in the first and second supplying operations. With this, moisture is supplied in these supplying operations even if the ink adhering to the lip component 12 or the like is thickened. Because the viscosity of the ink is decreased, the ink is easily ejected to the opposing member 10 side in the second supplying operation.

In the first and second supplying operations, non-humidified air may be supplied from the openings 51*a* and 51*b*. The gathering of ink in the first supplying operation and the ejection of the gathered ink in the second supplying operation are possible in this case, and the effects similar to the embodiment above are achievable. Furthermore, moist air may be supplied in the sealed state in the second supplying operation. In such a case, because the supplied moist air predominantly flows from the second path R2 toward the first path R1, it is possible to eject the ink having been gathered to the opening 51*b* side to the opposing member 10 side. If in this case the hydrophilicity of the surface 10*a* is higher than that of the lip component 42, the movement of the ink to the surface 10*a* is facilitated. The effects similar to those of the embodiment above are therefore achieved. Furthermore, in the step F7, the lip component 42 may be moved to the separated position while the opposing member 10 is not moved. It is possible also in this case to eject the ink having been gathered to the opening 51*b* side to the opposing member 10 side. Furthermore, the head 1 may be polygonal or circular rather than rectangular in plan view.

The present invention is applicable to both line-type printers and serial-type printers. Furthermore, the present invention is applicable not only to printers but also to facsimile machines, photocopiers, or the like. Furthermore, the present invention is applicable to liquid ejection apparatuses that perform recording by ejecting liquid which is not ink. The recording medium is not limited to the sheet P. Various types of recordable media may be used as the recording medium. Furthermore, the present invention is applicable irrespective of the ink ejection method. For example, while in the present embodiment the piezoelectric elements are used, the ink ejection method may be a resistance heating method or a capacitive sensing method.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a liquid ejection head having an ejection surface on which a plurality of ejection openings are formed;

a capping unit that includes:

an annular lip component enclosing the liquid ejection head, an opposing member opposing the ejection surface over an ejection space opposing the ejection surface, a lip moving mechanism configured to move the lip component between an abutting position where the lip component abuts to a surface of the opposing member and a separated position where the lip component is separated from the surface of the opposing member, and an elastic diaphragm connecting the lip component with a side face of the liquid ejection head, the capping unit being able to take either a sealed state in which the lip component is at the abutting position and abuts to the opposing member and the ejection space is isolated from an external space or an open state in which the lip component is separated from the opposing member and the ejection space is open to the external space, wherein the hydrophilicity of a surface of the opposing member is greater than the hydrophilicity of a surface of the lip component;

a supply unit that includes a first opening and a second opening provided to sandwich the ejection openings and is configured to supply air to the ejection space via the first opening or the second opening;

a wiping unit configured to execute a wiping operation to wipe the surface of the opposing member;

a maintenance controller configured to control the capping unit, the wiping unit, and the supply unit; and an output unit configured to output a maintenance signal in response to either performance of a predetermined operation or satisfaction of a predetermined condition concerning time, wherein, when the lip component is positioned at the abutting position, a first path that allows air passing through the first opening to flow therein and extends along an inner circumferential surface of a first region of the lip component and a second path which allows air passing through the second opening to flow therein and extends along an inner circumferential surface of a second region of the lip component which region opposes the first region being formed, whereas, in the sealed state, a third path connecting the first path with the second path being formed between the lip component and a side face of the liquid ejection head, and wherein, in response to the maintenance signal output from the output unit, the maintenance controller is configured to: execute a first supplying operation to supply the air through the first opening to the ejection space in the sealed state, then execute a second supplying operation to supply the air through the second opening to the ejection space in the sealed state or the open state, and then establish the sealed state after executing the wiping operation in the open state.

2. The liquid ejection apparatus according to claim 1, wherein, the wiping unit is configured to wipe the surface of the opposing member from a non-edge part of a region opposing the ejection space to a position passing over a region contacting the second region of the lip component in the wiping operation after the second supplying operation.

3. The liquid ejection apparatus according to claim 1, wherein, the supplying unit is configured to supply air from the second opening while the ejection space is in the open state in the second supplying operation.

4. The liquid ejection apparatus according to claim 3, wherein, a pressure to supply the air in the second supplying operation is higher than a pressure to supply the air in the first supplying operation, and the pressure to supply the air in the first supplying operation is equal to or lower than a resisting pressure of a liquid meniscus formed at each of the ejection openings, which is the maximum pressure with which the liquid meniscus is not broken.

5. The liquid ejection apparatus according to claim 3, wherein, the capping unit further includes an opposing member moving mechanism that moves the opposing member between a first position where the opposing member abuts to the lip component when the lip component is at the abutting position and a second position which is farther from the ejection surface than the first position in a direction in which the lip component moves, and after the second supplying operation and before the wiping operation, the maintenance controller causes the opposing member to move to the second position by using the opposing member moving mechanism.

6. The liquid ejection apparatus according to claim 5, wherein, after the first supplying operation and before the second supplying operation, the maintenance controller causes the opposing member to move to a liquid ejection position which is between the first position and the second position by using the opposing member moving mechanism.

7. The liquid ejection apparatus according to claim 1, further comprising:

a generation unit that generates moist air, the supply unit supplying the moist air generated by the generation unit to the ejection space via the first opening or the second opening.

8. The liquid ejection apparatus according to claim 7, wherein, after the ejection space is switched to the sealed state after the second supplying operation, the maintenance controller controls the supply unit so that the moist air is supplied to the ejection space via the first opening or the second opening.

9. The liquid ejection apparatus according to claim 1, further comprising:

an ejection unit that executes a liquid ejection operation to apply a pressure to liquid in the liquid ejection head so as to forcibly eject the liquid through the ejection openings, the wiping unit executing an ejection surface wiping operation to wipe the ejection surface, prior to the first supplying operation, the maintenance controller executing the wiping operation after executing the ejection surface wiping operation subsequent to the liquid ejection operation, and in the ejection surface wiping operation, the ejection surface being wiped in a direction along an airflow in the first supplying operation.

10. The liquid ejection apparatus according to claim 9, wherein, in the ejection surface wiping operation, the ejection surface is wiped to a position opposing the second path that extends along the inner circumferential surface of the second region of the lip component.

11. A method of maintaining a liquid ejection head having an ejection surface on which a plurality of ejection openings are formed, comprising:

moving an annular lip component of a capping unit between an abutting position, in which the lip component abuts to a surface of an opposing member opposing the ejection surface over an ejection space opposing the ejection surface, and a separated position, in which the lip component is separated from the surface of the opposing member, and moving the capping unit between a sealed state in which the lip component is at the abutting position and abuts to the opposing member and the ejection space is isolated from an external space and an open state in which the lip component is separated from the opposing member and the ejection space is open to the external space, wherein the hydrophilicity of a surface of the opposing member is greater than the hydrophilicity of a surface of the lip component;

supplying air to the ejection space via a first opening of a supply unit or a second opening of a supply unit, the first opening and the second opening provided to sandwich the ejection openings;

executing a wiping operation with a wiping unit to wipe the surface of the opposing member;

outputting a maintenance signal in response to either performance of a predetermined operation or satisfaction of a predetermined condition concerning time, wherein, when the lip component is positioned at the abutting position, a first path allows air passing through the first opening to flow therein and extends along an inner circumferential surface of a first region of the lip component and a second path allows air passing through the second opening to flow therein and extends along an inner circumferential surface of a second region of the lip component which region opposes the first region, whereas, in the sealed state, a third path connecting the first path with the second path is formed between the lip component and a side face of the liquid ejection head, and wherein, in response to the maintenance signal being output, executing a first supplying operation to supply the air through the first opening to the ejection space in the sealed state, then executing a second supplying operation to supply the air through the second opening to the ejection space in the sealed state or the open state, and then establishing the sealed state after executing the wiping operation in the open state.

12. A non-transitory computer readable medium storing instructions that, when executed by a processor, cause processes to be performed comprising:

moving an annular lip component of a capping unit between an abutting position, in which the lip component abuts to a surface of an opposing member opposing an ejection surface of a liquid ejection head over an ejection space opposing the ejection surface, and a separated position, in which the lip component is separated from the surface of the opposing member, and moving the capping unit between a sealed state in which the lip component is at the abutting position and abuts to the opposing member and the ejection space is isolated from an external space and an open state in which the lip component is separated from the opposing member and the ejection space is open to the external space, wherein the hydrophilicity of a surface of the opposing member is greater than the hydrophilicity of a surface of the lip component;

supplying air to the ejection space via a first opening of a supply unit or a second opening of a supply unit, the first opening and the second opening provided to sandwich ejection openings formed on the ejection surface;

executing a wiping operation with a wiping unit to wipe the surface of the opposing member;

outputting a maintenance signal in response to either performance of a predetermined operation or satisfaction of a predetermined condition concerning time, wherein, when the lip component is positioned at the abutting position, a first path allows air passing through the first opening to flow therein and extends along an inner circumferential surface of a first region of the lip component and a second path allows air passing through the second opening to flow therein and extends along an inner circumferential surface of a second region of the lip component which region opposes the first region, whereas, in the sealed state, a third path connecting the first path with the second path is formed between the lip component and a side face of the liquid ejection head, and wherein, in response to the maintenance signal being output, executing a first supplying operation to supply the air through the first opening to the ejection space in the sealed state, then executing a second supplying operation to supply the air through the second opening to the ejection space in the sealed state or the open state, and then establishing the sealed state after executing the wiping operation in the open state.

* * * * *